United States Patent [19]

Yamamoto et al.

[11] Patent Number: 4,731,979

[45] Date of Patent: Mar. 22, 1988

[54] CAPSULE FILLING APPARATUS

[75] Inventors: Taizo Yamamoto, Osaka; Hirokazu Konishi, Sakurai, both of Japan

[73] Assignee: Nippon Elanco Kabushiki Kaisha, Osaka, Japan

[21] Appl. No.: 833,075

[22] Filed: Feb. 26, 1986

[30] Foreign Application Priority Data

| | | | |
|---|---|---|---|
| Feb. 27, 1985 | [JP] | Japan | 60-40117 |
| Mar. 15, 1985 | [JP] | Japan | 60-52971 |
| Mar. 18, 1985 | [JP] | Japan | 60-55480 |
| Jan. 30, 1986 | [JP] | Japan | 61-19261 |

[51] Int. Cl.[4] ..... B30B 11/00; B65B 1/24; B65B 1/38

[52] U.S. Cl. ..... 53/529; 53/281; 53/900

[58] Field of Search ..... 53/503, 281, 504, 529, 53/530, 266 R, 276, 329, 560

[56] References Cited

U.S. PATENT DOCUMENTS

| | | | |
|---|---|---|---|
| 1,565,729 | 12/1925 | Genat | 53/529 X |
| 2,567,052 | 9/1951 | Carruthers | 53/529 X |
| 3,179,041 | 4/1965 | Luthi et al. | 53/529 X |
| 3,371,689 | 3/1968 | Carruthers | 53/529 X |
| 3,476,037 | 11/1969 | Gorby | 53/529 X |
| 3,538,677 | 11/1970 | Amoroso et al. | 53/900 X |
| 3,978,640 | 9/1976 | Crossley et al. | 53/900 X |
| 4,091,600 | 5/1978 | Itoh | 53/900 X |
| 4,163,354 | 8/1979 | Austin | 53/900 X |
| 4,330,252 | 5/1982 | Bullock et al. | 53/529 X |
| 4,584,817 | 4/1986 | Yamamoto et al. | 53/329 |

*Primary Examiner*—Horace M. Culver

*Attorney, Agent, or Firm*—Birch, Stewart, Kolasch & Birch

[57] ABSTRACT

A capsule filling machine comprising a turntable supported for intermittent rotation about a vertical shaft. The turntable when at one work station receives in top-capped posture empty capsules each comprising an empty cup body having a cap body mounted thereon in telescopic fashion. The turntable is passed during one complete rotation through a plurality of work stations, at which the separation of the cap body from the cup body, the filling of a material into the cup body, the mounting of the cap body on the filled cup body to provide a filled capsule, and the ejection of the filled capsule are successively and sequentially performed. The empty capsule and the cap body, separated from the associated cup body, are conveyed along a horizontal circumferential path whereas the cup body in a region of separation is conveyed along a modified path including a side way extending outwardly and downwardly with respect to the horizontal circumferential path.

11 Claims, 32 Drawing Figures

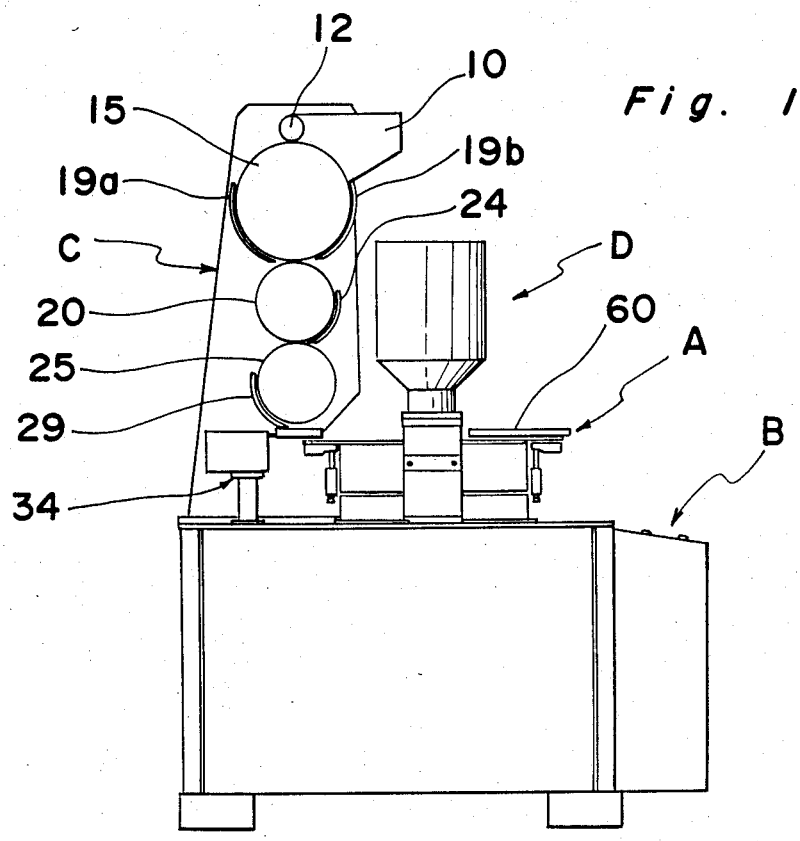
Fig. 1
Fig. 2
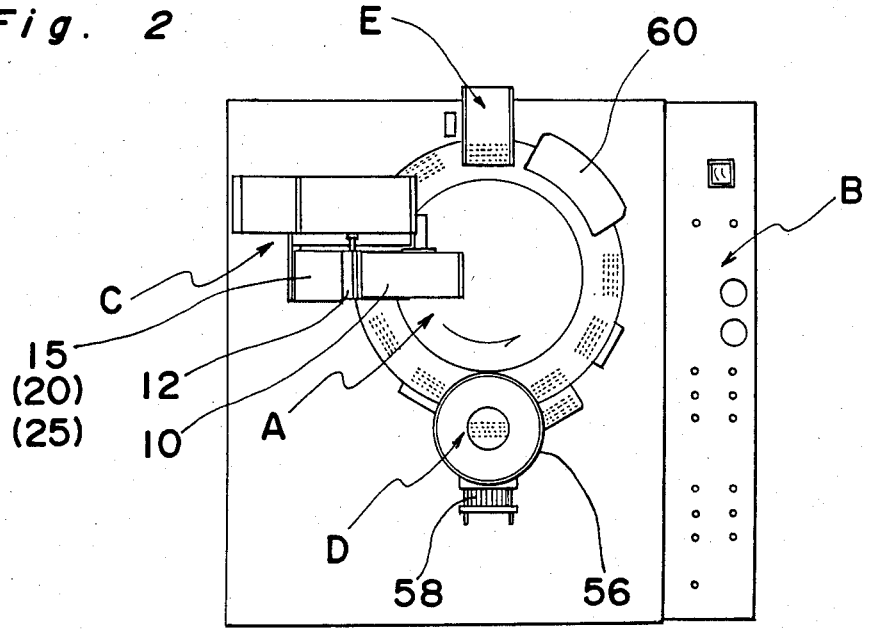

Fig. 10
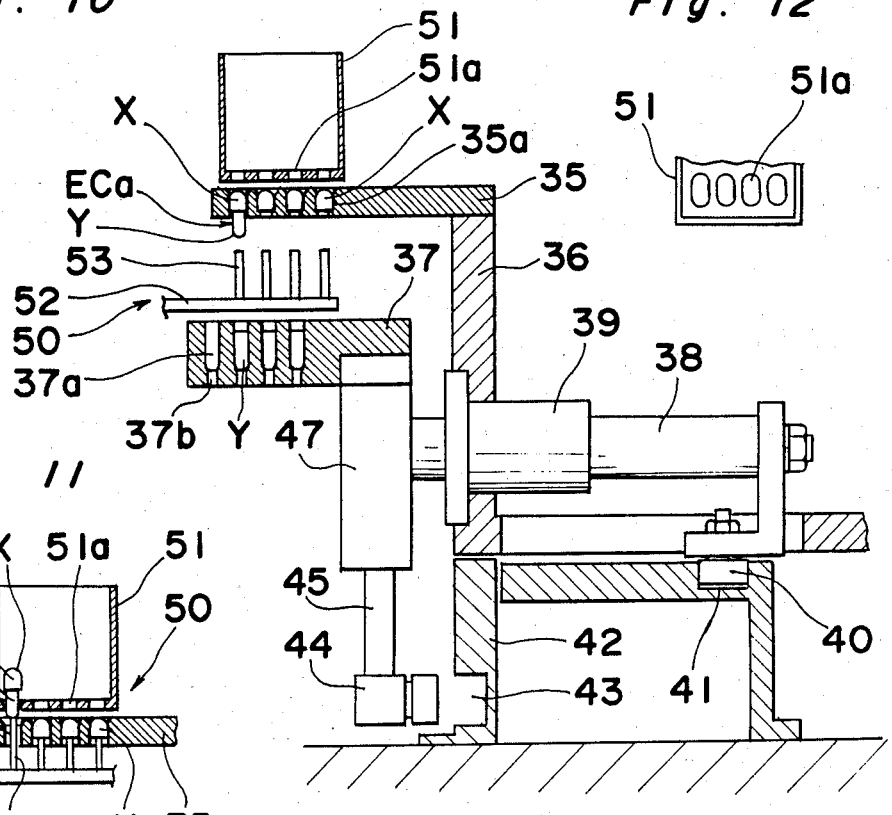
Fig. 12
Fig. 11
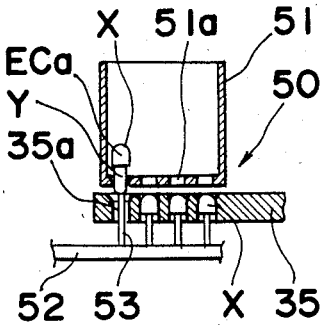
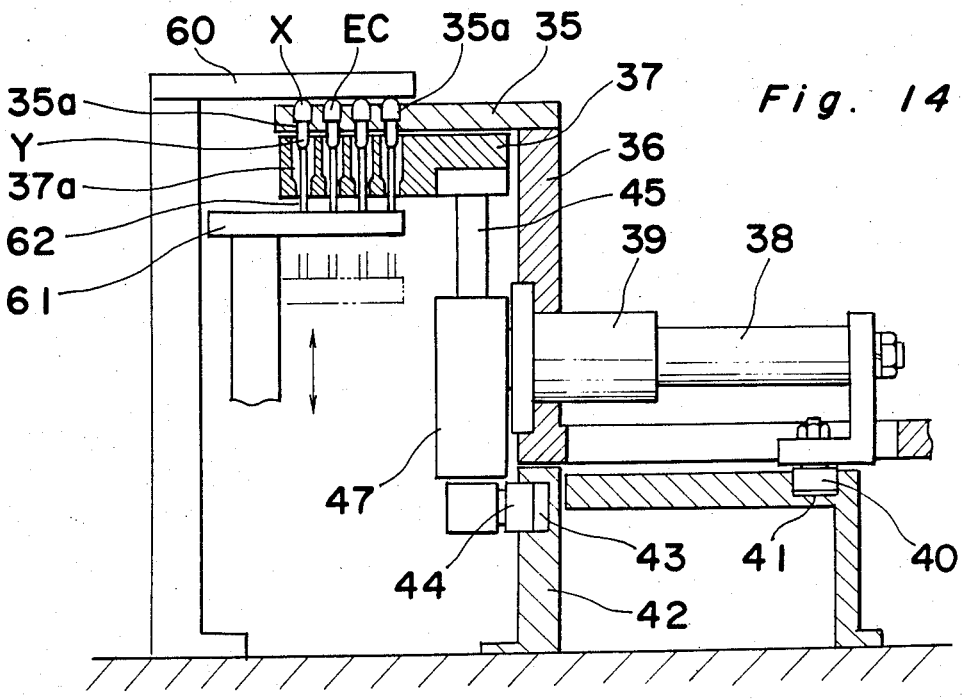
Fig. 14

112
Po
103a
103
136
132
113(or 114)
137
107b
P
134
Y
37
37a
Station W1
Stations W2 & W3
Station W4
Station W5

CAPSULE FILLING APPARATUS

BACKGROUND OF THE INVENTION

The present invention relates to a capsule filling apparatus for filling a filler material such as, for example, powder, slurry or oil paste, into capsules such as hard gelatin capsules.

The capsules referred to above are generally supplied in a prelocked condition, i.e., a condition in which the capsule cap body is mounted on the capsule cup body, but can readily be removed therefrom at any desired or required time for, for example, filling of the filler material thereinto. Accordingly, in order for the prelocked capsules to be efficiently filled with the material, a series of procedures including, for example, the receipt of each prelocked capsule, the separation of the capsule cap body from its mating capsule cup body. the filling of the material into the capsule cup body, the capping of the filled capsule cup body and the ejection of each filled capsule, must be continuously carried out at respective stations disposed around, for example, a turntable.

In one prior art filling machine, there is employed a system wherein the capsule cap body and cup body are merely separated from each other in a vertical direction. In another prior art filling machine, there is employed a system wherein the capsule cap body separated from the associated capsule cup body is moved horizontally so that it can wait at a position latterally of the associated capsule cup body before the filling of the material into such associated cup body completes. In the first mentioned system, since a sufficient space can be obtained between the separated cap body and cup body, a combination with such a bulky apparatus as a slurry filling mechanism has been impossible. On the other hand, in the last mentioned system, since the direction in which the cap body is moved horizontally must be a centripetal direction, the apparatus tends to be unnecessarily overdimensioned.

SUMMARY OF THE INVENTION

The present invention has been developed with a view to substantially eliminating the above described disadvantages and inconveniences inherent in the prior art apparatuses and has for its essential object to provide a systemized apparatus fabricated in a compact size while incorporating a complicated and bulky slurry filling mechanism and other associated machine units, which apparatus is capable of exhibiting high productivity.

In order to accomplish the above object, the present invention provides a capsule filling machine comprising a turntable supported for intermittent rotation about a vertical shaft, said turntable when at one work station receiving at least one empty capsule in top-capped posture, said empty capsule comprising an empty cup body having a cap body mounted thereon in telescopic fashion, said turntable being passed during one complete rotation through a plurality of work stations, including said one work station, at which the separation of the cap body from the cup body, the filling of a material into the cup body, the mounting of the cap body on the filled cup body to provide a filled capsule, and the ejection of the filled capsule are successively and sequentially performed, said empty capsule and said cap body, separated from the associated cup body, being conveyed along a horizontal circumferential path whereas the cup body in a region of separation is conveyed along a modified path including a side way extending outwardly and downwardly with respect to the horizontal circumferential path.

In the machine of the above described construction according to the present invention, a plurality of groups of a plurality of the capsules are substantially subjected to the operations, respectively.

During the intermittent rotation of the turntable, the cap body is transported along the horizontal circumferential path while received in a cap body receiving pocket defined in a cap body carrier disc mounted atop the turntable. On the other hand, the cup body is transported while received in a cup body receiving pocket defined in a cup body carrier segment movable along the modified path.

Moreover, according to the present invention, the cup body carrier segment is employed in a plural number, and is mounted on a respective rod, said respective rod being supported by a bracket for movement up and down, said bracket being mounted on a respective arm which extends radially outwardly from a cam follower engaged in a positive motion cam arranged in a fixed member below the cap body carrier disc, the arms for each cup body carrier segment being movable in synchronism with the cap body carrier disc and telescopically movable in a direction radially outwardly in dependence on the position of the cap body carrier disc. The rod has a cam follower engaged in a positive motion cam provided in a fixed member of the bottom of the turntable, and is downwardly biased by a spring relative to the bracket and is moved up and down in dependence on the work stations.

Therefore, as the turntable rotates, the cup body carrier segment is displaced first in a direction downwardly of the axis of rotation of the turntable and then in a direction radially outwardly thereof during the passage thereof through particular work stations and, after the passage therethrough along an arcuate path outwardly of the cap body carrier disc, said segment is radially inwardly shifted while upwardly shifted to return to the circumferential path.

In this construction, the defective capsule in which the cap body and the cup body are not separated from each other is removed at one of the work stations at which the cup body carrier segment is downwardly shifted. On the other hand, the filling of the material into the cup body is carried out at one of the work stations where the arcuate path is situated, and the capping after the filling is carried out at one of the work positions where the cup body carrier segment displaces from the arcuate path to the circumferential path.

BRIEF DESCRIPTION OF THE DRAWINGS

This and other objects and features of the present invention will become clear from the following description taken in conjunction with a preferred embodiment with reference to the accompanying drawings, in which:

FIGS. 1 and 2 are schematic side and top views of a capsule filling machine according to the present invention, respectively;

FIG. 10 is a view similar to FIG. 7, showing a defective capsule rejecting unit;

FIG. 11 is a side sectional view of a defective capsule recovery box, showing the method in which the defective capsule is ejected into the box;

FIG. 12 is a top plan view of a portion of the recovery box;

FIG. 14 is a view similar to FIG. 7, showing a capping unit;

DETAILED DESCRIPTION OF THE EMBODIMENT

Figure 3:
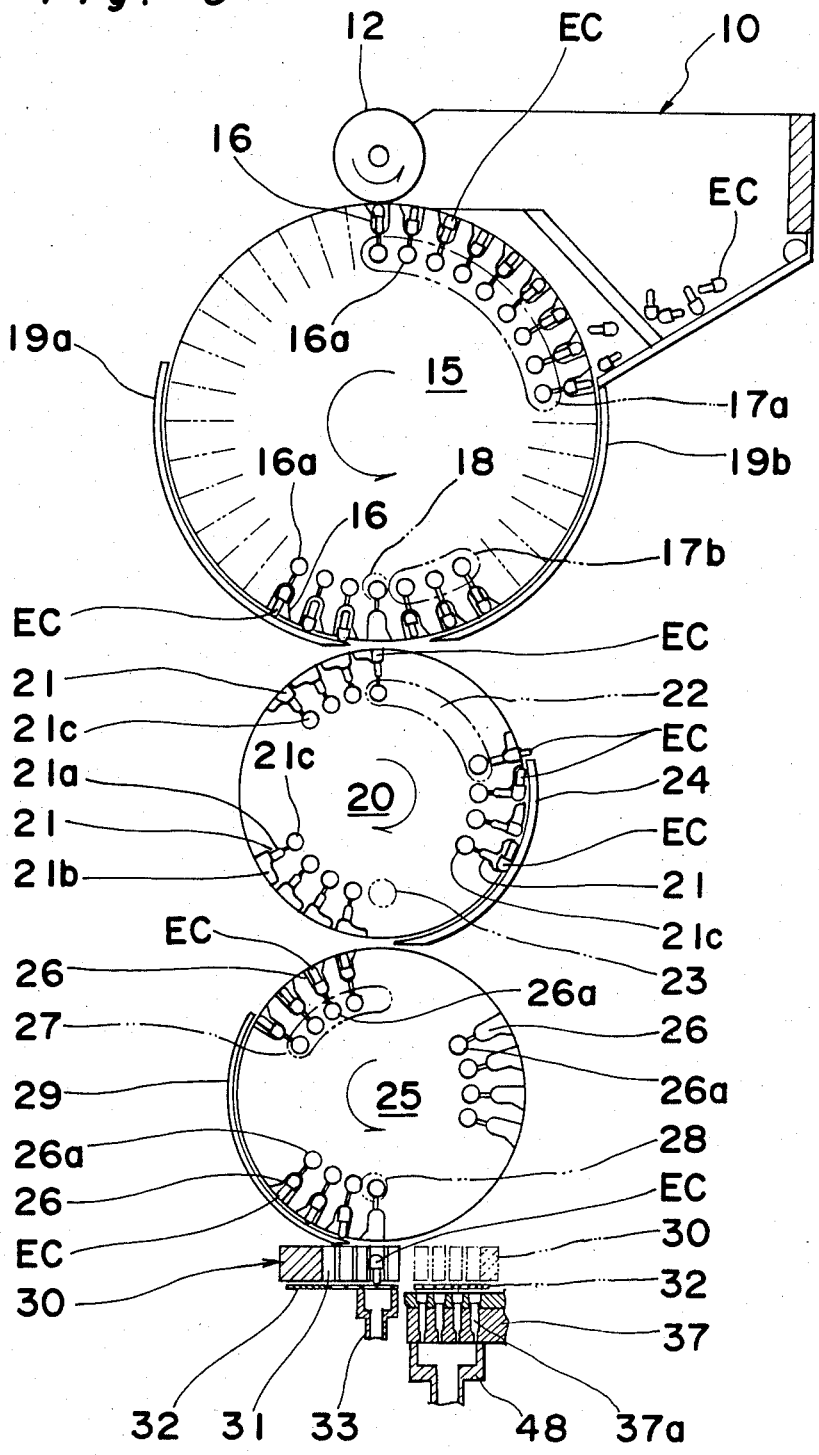
FIG. 3 is a schematic side sectional view, on an enlarged scale, of a capsule rectifying unit used in the machine.

Before the description of the present invention proceeds, it is to be noted that like parts are designated by like reference numerals throughout the accompanying drawings.

Referring first to FIGS. 1 and 2 showing a capsule filling system in schematic representation, the capsule filling machine shown therein comprises a filling unit A, a gauge and control panel B therefor, a capsule rectifying unit C, a constant quantity dispensing unit D, and a capsule ejecting unit E. These units A to E are operatively associated and synchronized so as to achieve a sequence of intended functions in cooperation with their related components not shown in FIGS. 1 and 2. These units A to E will now be described individually in detail.

I. Capsule Rectifying Unit

Referring to FIG. 3, the capsule rectifying unit shown therein in schematic side sectional representation comprises a hopper 10, a supply drum 15 supported for rotation in one direction generally below the hopper 10 with an outer peripheral portion thereof protruding into the hopper 10, a rectifying drum 20 supported immediately below the supply drum 15 for rotation in a direction counter to the direction of rotation of the supply drum 15, and a delivery drum 25 supported immediately below the rectifying drum 20 for rotation in a direction counter to the direction of rotation of the rectifying drum 20. These drums 15, 20 and 25 are adapted to be driven in their respective directions at the same peripheral speeds. Positioned immediately above and supported for rotation in a direction counter to the direction of rotation of the supply drum 15 is a roll brush 12 operable to facilitate the random insertion of some of empty capsules EC, accommodated randomly within the hopper 10, into pockets 16 defined in the outer peripheral surface of the supply drum 15 as will be described subsequently.

Although only some of the pockets 16 are shown in FIG. 3, the pockets 16 are distributed in at least one circumferentially extending row all over the outer peripheral surface of the supply drum 15 in equally spaced relation to each other and so formed in the supply drum 15 as to extend in a direction radially of the drum 15. Each of the pockets 16 has a minimum diameter enough to accommodate therein a cap body of each empty capsule EC, that is, slightly greater than the outer diameter of the cap body of each empty capsule EC, a portion of the opening of each pocket 16 being substantially flared outwardly in a direction conforming to the direction of rotation of the supply drum 15. Specifically, each of the pockets 16 is so shaped and so sized that, as some of the pockets 16 successively move through the hopper 10 during each complete rotation of the supply drum 15, some of the empty capsules EC within the hopper 10 can be randomly received into the associated pockets 16 regardless of the posture of each empty capsule EC. It is to be noted that, for the purpose of description of the present invention, the posture wherein each capsule is received within the respective pocket or a similar receptacle with the associated cap body oriented towards the bottom of such pocket or receptacle will be referred to as "bottom-capped position" whereas that with the associated cap body oriented towards the top of such pocket or receptacle will be referred to as "top-capped position". The roll brush 12 serves to sweep some of the empty capsules EC, resting on the outer peripheral surface of the drum 15 without being received in any pockets 16, off from the drum 15 into the hopper 10.

Each of the pockets 16 has a passage 16*a* defined in the drum 15 in communication with the respective pocket 16. All of the passages 16*a* are arranged in a circle concentric with the axis of rotation of the drum 15, and some of them are adapted to be successively communicated with a source of vacuum through a vacuum shoe 17*a* which extends so as to follow the curvature of the circle of the passages 16*a* for evacuating some of the pockets 16 then passing through the interior of the hopper 10. During the rotation of the drum 10, the passages 16*a* can also be successively communicated with a source of compressed air through a blow shoe 18, defined in register with a first meeting point where the supply and rectifying drums 15 and 20 are spaced the minimum distance from each other, and again with the source of vacuum through another vacuum shoe 17*b* defined next to the blow shoe 18 on the leading side with respect to the direction of rotation of the drum 15.

Thus, it will readily be seen that, during each complete rotation of the supply drum 15, some of the empty capsules EC within the hopper 10 can be sucked into the respective pockets 16 then communicated with the vacuum source through the associated passage 16*a* and the vacuum shoe 17*a* and are transported towards the first meeting point. At the first meeting point, the pockets 16 are successively communicated with the compressed air source one at a time through the associated passages 16*a* and the blow shoe 18 for the transfer of the empty capsule EC from the supply drum 15 onto the rectifying drum 20 as will be described subsequently. As will become clear from the subsequent description, some of the empty capsules EC which are not successively transferred onto the rectifying drum 20 are again sucked into and retained in the respective pockets 16 upon the subsequent communication of the associated passages 16*a* with the vacuum source through the vacuum shoe 17*b*, and are transferred onto the rectifying drum 20 at the first meeting point during the next cycle of rotation of the supply drum 15. This design makes it possible to minimize any possible failure in capsule supply.

Positioned radially outwardly of the lower half of the supply drum 15 and extending from a position adjacent the first meeting point in opposite directions away from each other so as to follow the curvature of the outer periphery of the drum 15 is trailing and leading guard plates 19*a* and 19*b* operable to avoid any possible separation and fall of some empty capsules EC out from the associated pockets 16 during the transportation thereof by the supply drum 15. It is to be noted that the number of the pockets 16 in the supply drum 15 is, for example, 36, although it may not be always limited thereto and may be any desired number.

The rectifying drum 20 is operable to transport the empty capsules EC, received successively from the supply drum 15 at the first meeting point, towards the second meeting point where the outer periphery surface of the rectifying drum 20 is spaced the minimum possible distance from that of the delivery drum 25 positioned immediately therebelow, while allowing the empty capsules EC, being transported thereby, to be rectified in a definite position required for all of the empty capsules to be received by the delivery drum 25 in bottom-capped posture or position. As shown, the rectifying drum 20 has its outer peripheral surface formed with at least one circumferential row of a plurality of, for example, three, groups of four equally spaced pockets 21 each group defined therein so as to extend generally radially inwardly thereof, the three groups of the pockets 21 being spaced an equal distance from each other in a direction circumferentially of the drum 20 while leaving an equal number of smooth surface regions each between the neighboring groups of the pockets 21.

Each of the pockets 21 in the rectifying drum 20 comprises a radial pocket portion 21*a* of a diameter enough to accommodate therein only the cup body of each capsule EC, i.e., slightly greater than the outer diameter of the cup body of each capsule, but smaller than the outer diameter of the cap body of each capsule, and a transverse pocket portion 21*b* extending in a trailing direction circumferentially of the drum 20 and having a leading end communicated with and continued to the respective radial pocket portion 21*a*, the length of said transverse pocket portion 21*b* corresponding to the length of each empty capsule EC. The rectifying drum 20 also has passages 21*c* equal in number to the total number of the pockets 21, defined therein in communication with the respective radial pocket portions 21*a* and arranged in a circle concentric with the axis of rotation of the rectifying drum 20.

As is the case with the pockets 16 in the supply drum 15, all of the pockets 21 in the rectifying drum 20 can be successively communicated with the vacuum source through a vacuum shoe 22, which extend angularly through a predetermined angle from a position in register with the first meeting point in a direction conforming to the direction of rotation of the drum 20, and then with the compressed air source through a blow shoe 23 positioned at a location in register with the second meeting point. More specifically, during each complete rotation of the rectifying drum 20, all of the groups of the pockets 21 are successively brought to the first meeting point at which the empty capsules EC successively blown off from the pockets 16 in the supply drum 15 are received in the pockets 21 in the rectifying drum 20 and then transported towards the second meeting point at which they are successively transferred from the rectifying drum 20 onto the delivery drum 25.

As hereinbefore described in connection with the supply drum 15, all of the empty capsules EC received in the pockets 16 are not always held in the definite position, and some are held in the top-capped position and some are in the bottom-capped position. Accordingly, while each empty capsule transported by the supply drum 15 while received in the associated pocket 16 in the bottom-capped position is, when transferred onto the rectifying drum 20 at the first meeting point, received in the associated pocket 21 with its cup body sucked into and retained in the respective radial pocket portion 21*a*, each empty capsule transported by the supply drum 15 while received in the associated pocket 16 in the top-capped position is at the first meeting point received in the associated pocket 21 with its cap body closing the opening of the respective radial pocket portion 21*a* and with its cup body partially protruding radially outwardly from the outer periphery of the rectifying drum 20.

All of the empty capsules EC which are being transported from the first meeting point towards the second meeting point by the rectifying drum 20 while received in the respective pockets 21 in the bottom-capped position with their cup bodies protruding radially outwardly from the outer periphery of the drum 20 can be successively laid down to lie within the respective transverse pocket portions 21*b* by the action of a rectifying plate 24. This plate 24 is positioned radially outwardly of the outer periphery of the drum 20, extending from a position in register with the leading end of the vacuum shoe 22 arcuately down to a position preceding to and in the close vicinity of the second meeting point. The rectifying plate 24 concurrently serves as a guard plate similar to the guard plate 19*a* associated with the supply drum 15, but has its trailing end remote from the second meeting point engageable with the radially outwardly protruding cup body of each empty capsule, that is received in the pockets 21 in the bottom-capped position, to lay it down. It is to be noted that the trailing end of the rectifying plate 24 is so positioned relative to the leading end of the vacuum shoe 22 that the trailing end of the rectifying plate 24 can engage the radially outwardly protruding cup body of the empty capsule EC substantially simultaneously with the incommunication of the pocket 21, receiving such empty capsule EC, from the vacuum source.

The delivery drum 25 positioned immediately below the rectifying drum 20 is operable to transport the empty capsules EC, transferred successively from the rectifying drum 20 at the second meeting position, towards a delivery station defined immediately below the delivery drum 25. This drum 25 is of a construction identical with the rectifying drum 20 except that all groups of the four pockets in each group, identified generally by 26, are identical in shape and size with the pockets 16 in the supply drum 15. The pockets 26 of all groups can, during each complete rotation of the delivery drum 25, be communicated with the vacuum source through their associated passages **26*a* and a vacuum shoe 27, extending a predetermined angle from a position in register with the second meeting point to a position in register with a trailing end of a guard plate 29, for receiving and retaining the empty capsules EC within the respective pockets 26, and then with the compressed air source through their associated passages 26*a* and a blow shoe 28 positioned in register with the delivery station. It is, however, to be noted that, unlike each pocket 16 in the supply drum 15, each pocket 26 in the delivery drum 25 has a portion of the opening thereof flared generally radially outwardly in a direction counter to the direction of rotation of the drum 25 and in opposite relation to that of the pocket 16 in the supply drum 15**.

Referring to the rectifying drum 20, each empty capsule received in the respective pocket 21 in the bottom-capped position, i.e., with its cap body protruding radially outwardly from the outer periphery of the drum 20 can be laid down in contact with the trailing end of the rectifying plate 24 so as to lie within the associated transverse pocket portion **21*b*, as hereinbefore described. At this time, the empty capsule received in the pocket 21 in the bottom-capped position is laid down in a trailing direction with respect to the direction of rotation of the drum 20, and the cap body of the laid-down empty capsule conforms to the direction of rotation of the drum 20 without being received in the radial pocket portion 21*a* of that pocket 21 by the reason which has been previously described. On the other hand, since the delivery drum 25 is driven in a direction counter to the direction of rotation of the rectifying drum 20 and since that portion of the opening of each pocket 26 in the delivery drum 25 is generally radially outwardly flared in the direction counter to the direction of rotation of the drum 25, all of the laid-down empty capsules transported by the rectifying drum 20 can, as they are successively brought to the second meeting point, be blow off from the respective pockets 16 into the mating pockets 26 in the delivery drum 25 with their cap bodies oriented radially inwardly of the drum 25**, having been reversed in position.

As regards the empty capsules transported by the rectifying drum 20 while received in the respective pockets 21 in the top-capped position, these top-capped empty capsules can, as they are brought to the second meeting point, be blown off from the pockets 21 straightforwards into the mating pockets 26 in the drum 25 without having been reversed in position because each top-capped empty capsule in the respective pocket 21 is at the second meeting point brought in line with the longitudinal axis of the associated pocket 26 in the drum 25 then aligned therewith.

The guard plate 29 extending from the position in register with the leading end of the vacuum shoe 27 to the position in the close vicinity of the delivery station while following the curvature of the outer periphery of the drum 25 serves to avoid any possible separation and fall of the capsule EC being transported by the delivery drum 25 towards the delivery station.

Positioned immediately below the delivery drum 25 is a reciprocating transfer unit including a transfer pallet 30 supported for linear movement between advanced and retracted positions, shown by the phantom line and the solid line, respectively, past the delivery station in a direction tangential to the outer periphery of the delivery drum 25. This reciprocating transfer pallet 30 has a row of cylindrical bottomless pockets 31 each extending completely through the thickness thereof and having a depth greater than the length of each capped capsule EC, said row of the bottomless pockets 31 extending in a direction conforming to the direction of movement of the transfer pallet 30. The transfer unit also includes a slide plate 32 slidable underneath the transfer unit between a support position in which the bottoms of the respective pockets 31 in the transfer pallet 30 are partially closed thereby, and a release position in which they are completely opened, and a vacuum cup 33 positioned immediately below the slide plate 32 in alignment with the delivery station.

From the retracted position shown by the solid line towards the advanced position shown by the phantom line, the transfer pallet 30 is driven at such a speed that all of the pockets 31 in the transfer pallet 30 can be successively brought into alignment with the pockets 26 of each group in the delivery drum 25 at the delivery station for receiving the respective empty capsules EC then blown off from the delivery drum 25. The slide plate 32 is at this time held at the support position, shown by the solid line, to prevent each of the capsules, then successively received from the delivery drum 25 into the respective pockets 31 in the transfer unit 30 at the delivery station, from being sucked into the suction cup 33 having passed through the respective pocket 31. During the movement of the transfer pallet 30 from the retracted position to the advanced position, the slide plate 32 moves together with the transfer pallet 30 from the support position to the release position which is aligned with the advanced position of the transfer pallet 30. However, as soon as the slide plate 32 arrives at the release position, the slide plate 32 starts its return movement back toward the support position relative to the transfer pallet 30 which starts its return movement back to the retracted position after the return of the slide plate 32. Therefore, at the advanced position of the transfer pallet 30, the capsules EC received in the respective pockets 31 are, as the slide plate 32 returns towards the support position, allowed to fall, or otherwise be sucked, into a receiving component of the capsule filling unit A which will be described later.

II. Capsule Filling Unit

Figure 4:
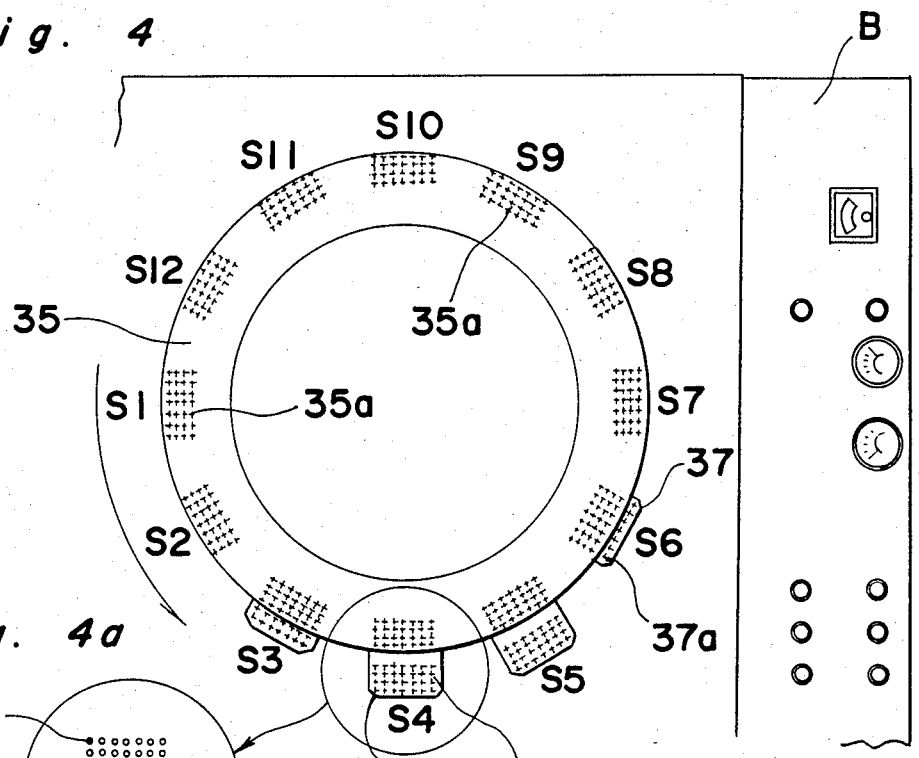
FIG. 4 is a top plan view of a portion of the machine showing a cap body carrier disc.
Figure 4A:
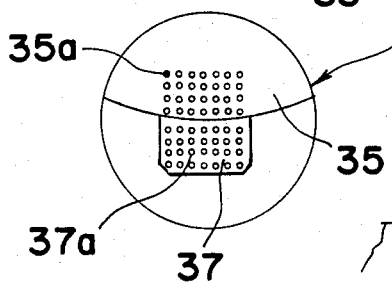
FIG. 4*a* is an enlarged view of a portion of FIG. 4.
Figure 5:
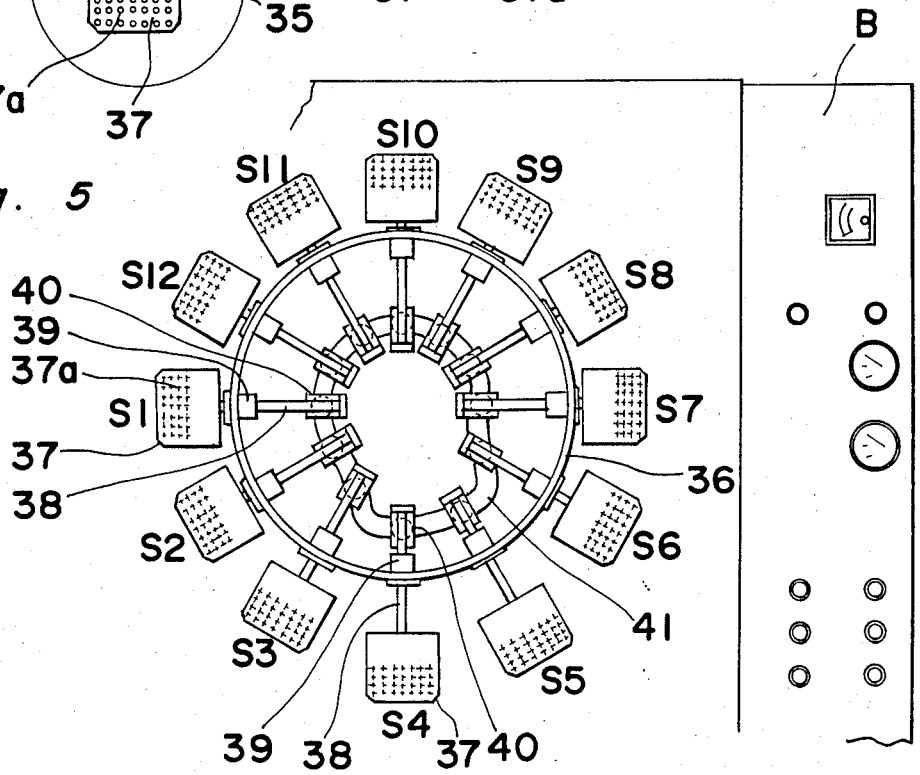
FIG. 5 is a top plan view of a portion of the machine with the cap body carrier disc removed to show an arrangement of cup body carrier segments.
Figure 6:
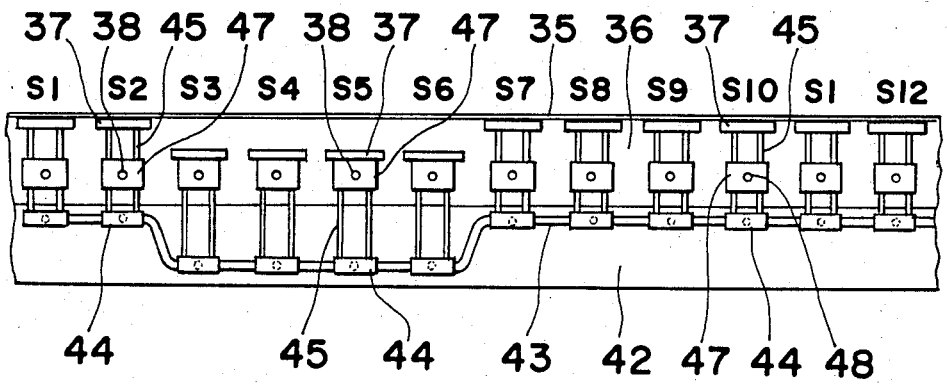
FIG. 6 is a side view of a depending cylinder developed into a plane representation.

The capsule filling unit is shown particularly in FIGS. 4 to 16. Referring first to FIGS. 4 to 6 in which the capsule filling unit is outlined, FIG. 4 illustrates a cap body carrier disc 35 mounted atop a turntable, with accessory components arranged thereabove, but removed for the purpose of clarity, and FIG. 5 illustrates a depending cylinder 36 intermittently rotatable together with the cap body carrier disc 35, a plurality of cup body carrier segments 37 movable incident thereto, and their related mechanisms. As best shown in FIG. 4*a* which illustrates, on an enlarged scale, a portion encircled by a circle in FIG. 4, the cap body carrier disc 35 has a plurality of circumferentially equally spaced groups of cap body receiving pockets 35*a* defined therein in a predetermined pattern, the number of said pockets 35*a* in each group being, for example 28, whereas each of the cup body carrier segments has cup body receiving pockets 37*a* defined therein in the same pattern as that of the pockets 35*a* in each group, the number of the cup body receiving pockets 37*a* in each segment 37 being equal to that of the cup body receiving pockets 35*a* in each group.

The cup body carrier segments 37 are connected with respective arms 38 in a manner as will be described later and positioned radially outwardly of the depending cylinder 36 while spaced an equal distance from each other in a direction circumferentially of the cylinder 36. Each of the arms 38 extends axially slidably through a respective bushing 39, secured to the depending cylinder 36, with its inner end remote from the respective segment 37 carrying a respective cam follower 40. All of the cam followers 40 carried by the respective arms 38 and positioned inside the depending cylinder 36 are mounted on and movably engaged to a positive motion cam 41 fixedly supported in position inside the depending cylinder 36 in any suitable manner. As will be described later, the positive motion cam 41 is so positioned and so shaped that, during each complete rotation of the cap body carrier disc 35 together with the depending cylinder 36, each of the neighboring cup body carrier segments 37 can be driven to a radially outwardly projected position for the purpose which will become clear from the subsequent description.

FIG. 6 illustrates the depending cylinder 36 and a fixed base cylinder 42 positioned coaxially below the depending cylinder 36, both cylinders 36 and 42 being developed in a plane. As shown, the fixed base cylinder 42 has a generally endless positive motion cam 43 secured to the outer peripheral surface thereof, on which cam 43 are movably mounted cam followers 44 and having a pair of spaced parallel rods 45 extending upwardly therefrom and terminating in rigid connection with the associated cup body carrier segment 37. As shown, each pair of the parallel rods 45 extend slidably through a respective bracket 47 rigidly mounted on the outer end of the associated arm 38. The positive motion cam 43 secured to the base cylinder 42 is so positioned and so shaped as to permit each four cup body carrier segments 37 to be lowered during each complete rotation of the cap body carrier disc 35 and, hence, the depending cylinder 36.

Thus, it is clear that, during each rotation of the cap body carrier disc 35 in one direction shown by the arrow in FIG. 4, the cup body carrier segments are not only successively moved in a direction radially outwardly of the depending cylinder 36 from a retracted position to a projected position, but also successively lowered. As will be described later, the positive motion cams 41 and 43 are so positioned and so shaped relative to each other that the successive lowering of the cup body carrier segments 37 can take place substantially simultaneously with the successive radially outward movement of the cup body carrier segments 37. It is, however, to be noted that, although some of the cam followers 44 engaged in the cam 43 are disengaged from the cam 43 during a period in which the associated cup body carrier segments are radially outwardly moved to the projected position, the rods 45 are downwardly biased as hereinbefore described and, therefore, the respective cup body carrier segment is maintained at a lowered position.

The cap body carrier disc 35 of the construction described above can, during each complete rotation thereof, be moved past a plurality of work stations, identified by S1 to S12, respectively, at which the following jobs take place.

| Station | Jobs |
|---|---|
| S1 | Capsule Loading and Opening |
| S2 | Transfer |
| S3 | Ejection of Defective Capsules |
| S4 & S5 | Fluid Filling |
| S6 & S7 | Transportation |
| S8 & S9 | Capping |
| S10 | Ejection |
| S11 | Cleaning |
| S12 | Transfer |

Figure 7:
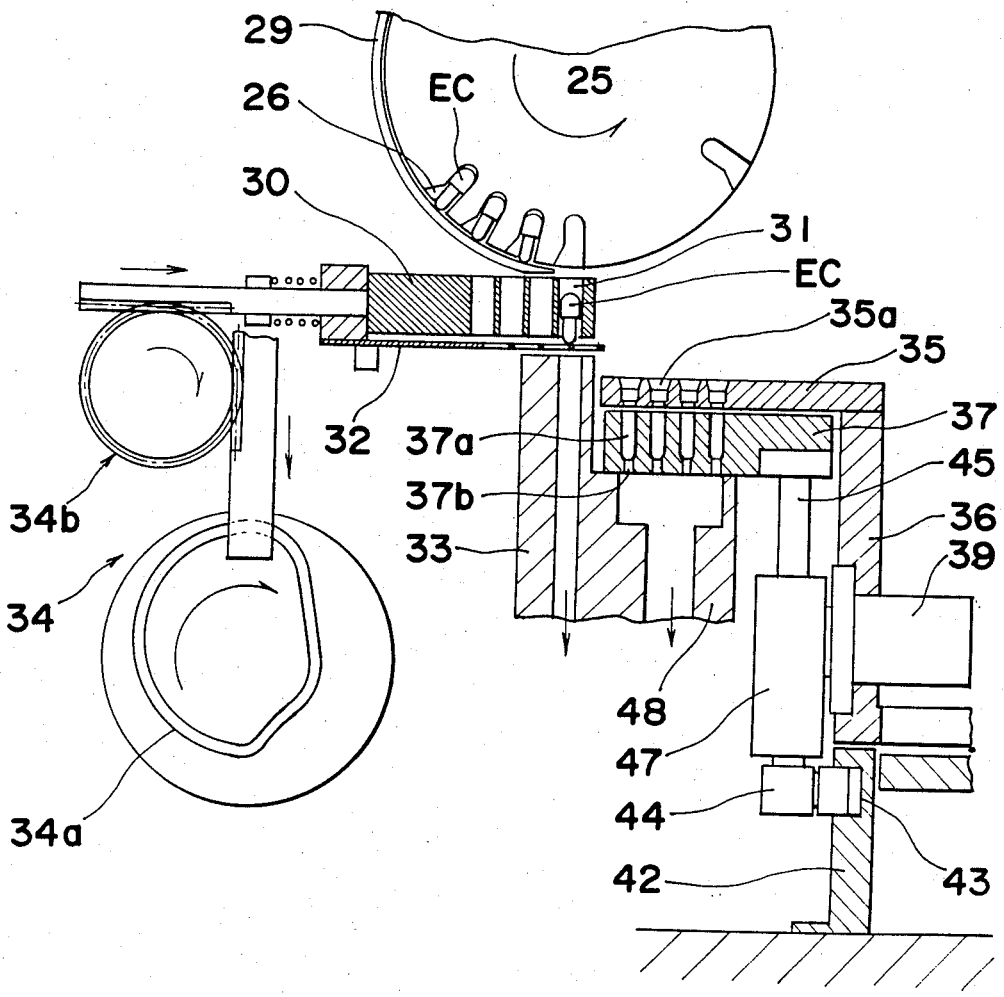
FIGS. 7 to 9 are schematic side sectional views, respectively, showing the sequence of delivery of the rectified capsules from the rectifying unit onto the cap body carrier disc and the subsequent separation of the cap body from the cup body of each capsule.
Figure 8:
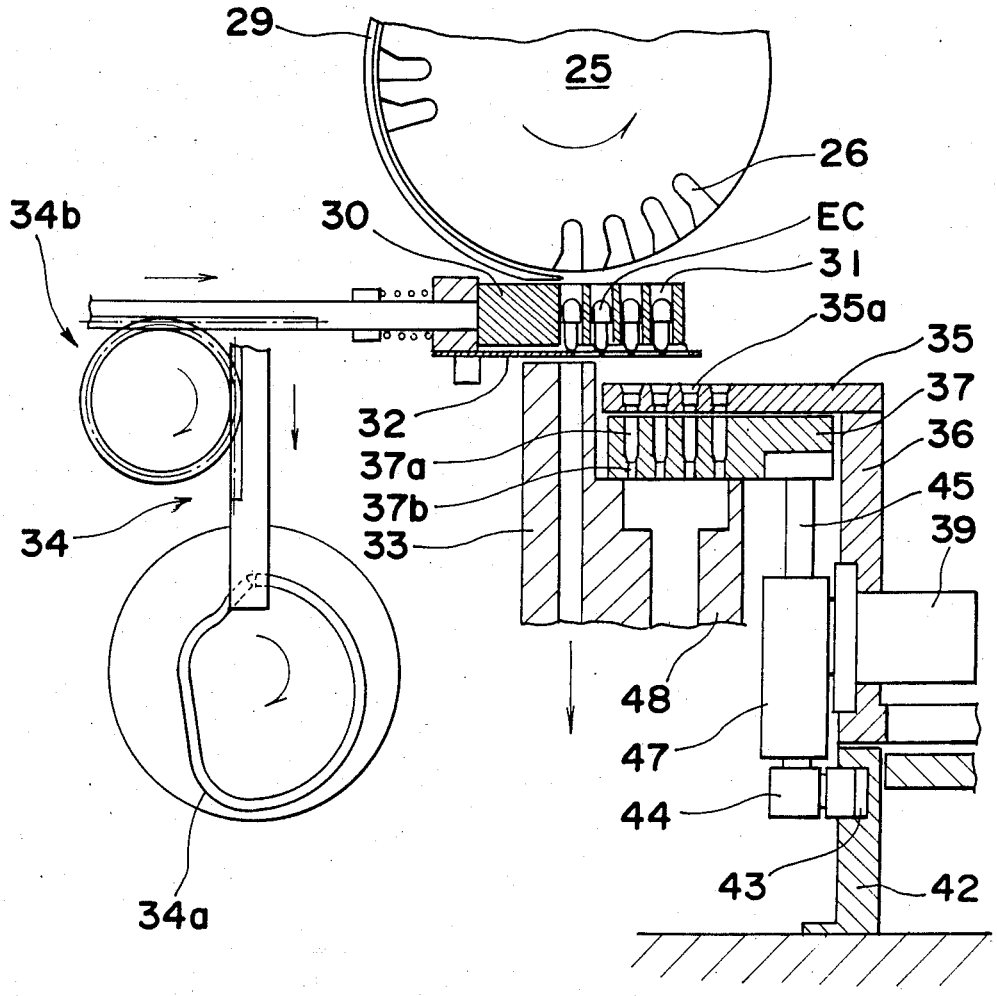
Figure 9:
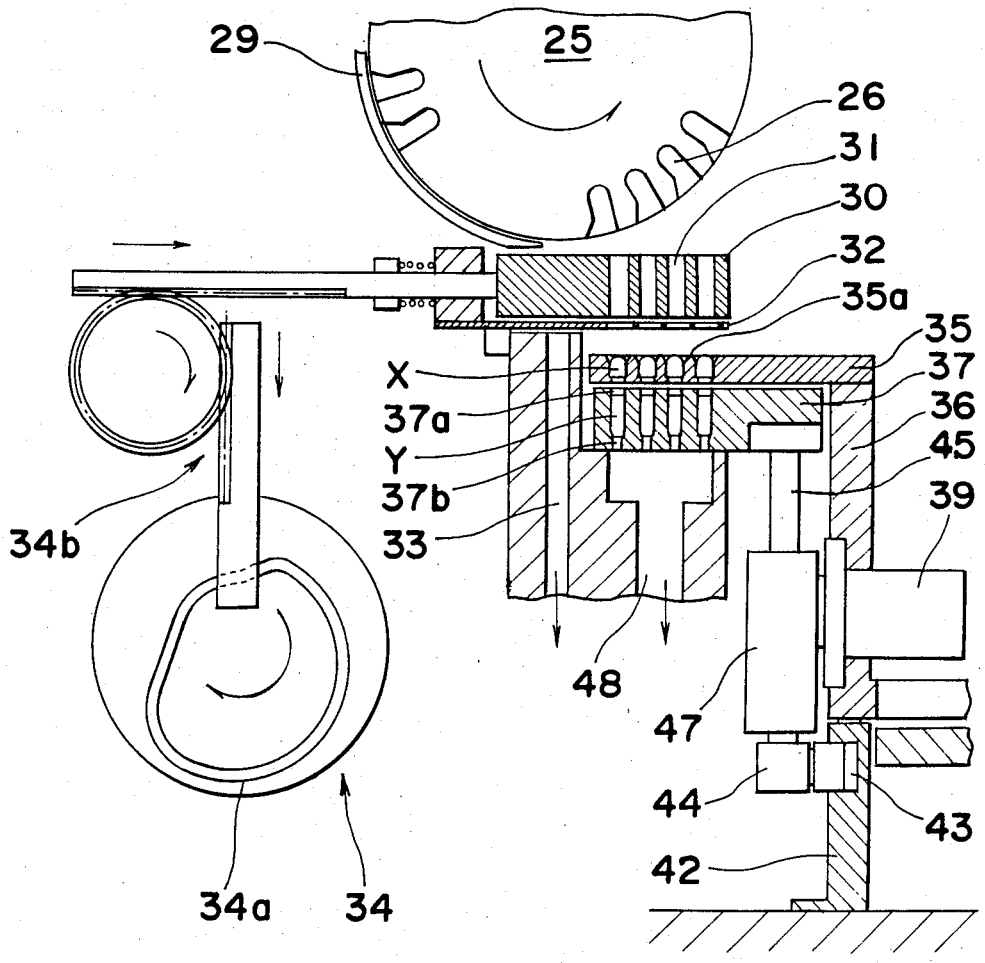

(1) Capsule Loading and Opening:

FIGS. 7 and 8 illustrate the sequence of capsule loading in which each four empty capsules EC which have been successively delivered in the predetermined position, i.e., the cap-topped position, from the delivery drum 25 are transported onto the carrier disc 35, and FIG. 9 illustrates the method of opening each of the capsules E, i.e, the separation of the cap body from the mating cup body in each of the capsules, so transported from the delivery station.

It is to be noted that each of the capsules supplied from the hopper towards the carrier disc 35 is in a prelocked form, i.e, in the form wherein the cup body is temporarily closed by the mating cap body with no powdery or fluid medicine filled therein, which cup body and cap body are respectively identified by Y and X throughout several views of the accompanying drawings in which each capsule is opened with the cap body separated from the cup body. It is also to be noted that the reciprocating transfer unit including the transfer pallet 30 and the slide plate 32 is driven by a drive unit generally identified by 34 and including a drive cam 34*a* and a motion translator 34*b*, the details of which will not be herein described for the sake of brevity.

Referring to FIGS. 7 to 9, the cup body carrier segments 37 which are successively brought into alignment with the capsule loading and separating station S1 during each complete rotation of the depending cylinder 36 are held at the lifted and radially inwardly retracted position as can be seen from FIGS. 4 to 6. While the particularly cup body carrier segment 37 is held in the lifted and radially inwardly retracted position with the cup body receiving pockets 37 aligned with one of the groups of the cap body receiving pockets 35*a* associated therewith, the transfer pallet 30 is brought to the advanced position together with the slide plate 32, as shown in FIG. 9, from the retracted position as shown in FIG. 7. Shortly before the transfer pallet 30 arrives at the advanced position, the slide plate 32 is held still at the release position so that the capsules EC so transported by the transfer pallet 30 can, simultaneously with the arrival of the pallet 30 at the advanced position, be positively drawn downwards by a suction force, induced in a suction cup 48 positioned beneath the carrier segment 37, into the pockets 35*a* and 37*a* then aligned with each other, as shown in FIG. 9.

Each of the cap body receiving pockets 35a in the cap body carrier disc 35 is in the form of a through-hole of a diameter enough to accommodate the inner diameter of each cap body, but having its lower region constricted radially inwardly to a diameter enough to accommodate the outer diameter of only the cup body. On the other hand, each of the cup body receiving pockets 37a in each carrier segment 37 is in the form of a hole of a diameter enough to accommodate the outer diameter of each cup body, having its bottom perforated at 37b so as to be communicable with the suction cup 48. Therefore, it will readily be seen that each of the capsules EC when received in the respective cup body receiving pocket 35a is separated into the cap body X, retained in the respective cap body receiving pocket 35a, and the cup body Y retained in the respective cup body receiving pocket 37a as clearly shown in FIG. 9. In this way, each of the capsules EC is opened in readiness for the filling of a predetermined quantity of, for example, powder as will be be described subsequently.

(2) Ejection of Defective Capsules:

When the group of the cap body receiving pockets 35a and its associated cup body carrier segment 37 are brought to the work station S3 incident to the intermittent rotation of the depending cylinder 36, the cup body carrier segment 37 is brought to a lowered position while having been radially outwardly moved a certain distance as shown in FIGS. 4 to 6 and 10. The function performed at this station S3 will not take place, if all of the capsules have been completely opened. However, assuming that one of the capsules fails to be opened, that is, assuming that the cap body and the cup body of one of the capsules are not separated from each other, at the station S1 and, therefore, the cup body of such one of the capsules remains suspended from the associated cap body retained in the cap body receiving pocket 35a as shown in FIG. 10, this defective capsule, now identified by ECa in FIGS. 10 and 11, can be removed from the carrier disc 35 in the manner which will now be described with particular reference to FIGS. 10 to 12.

At the station S3, there is disposed an ejecting mechanism generally identified by 50. This ejecting mechanism 50 comprises a recovery box 51 positioned above the cap body carrier disc 35 and having its bottom perforated at 51a in a pattern identical with the pattern of the cap body receiving pockets 35a in each group and in a size enough to pass the capsules therethrough into the interior of the recovery box 51. The mechanism 50 also comprises an ejector plate 52 having knock-out pins 53 equal in number to, and arranged in a pattern identical with, the cap body receiving pockets 35a, and rigidly mounted thereon so as to extend upwardly in alignment with the cap body receiving pockets 35a. The ejector plate 52 with the knock-out pins 53 is positioned between the carrier disc 35 and the cup body carrier segment 37 then held in the lowered position, and supported for movement between an inoperative position, as shown in FIG. 10, and a knock-out position, as shown in FIG. 11, in a direction away from and close towards the carrier disc 35, respectively.

It is to be noted that each of the knock-out pins 53 has a diameter smaller than the minimum diameter of each capsule, that is, the outer diameter of the cup body of each capsule, and has a length so selected as to terminate in the vicinity of the opening of each cap body received in the respective cap body receiving pocket 35a, when the ejector plate 52 is driven to the knock-out position as clearly shown in FIG. 11. Accordingly, when the ejector plate 52 is driven from the inoperative position towards the knock-out position, one of the knock-out pins 53 which is aligned with and immediately below the defective capsule ECa knocks the defective capsule ECa out of the associated cap body receiving pocket 35a and upwardly into the box 51 through a corresponding perforation 51a at the bottom of the box 51.

As best shown in FIG. 12, each of the perforations 51a defined in the bottom of the box 51 is in the form of a slot having its shorter axis slightly smaller than at least the outer diameter of the cap body, and therefore, there is no possibility that the defective capsule ECa once ejected into the box 51 may fall downwards through any one of the perforations 51a, although the defective capsule being ejected may be deformed inwardly as it passes through the perforations 51a into the box 51.

Figure 13:
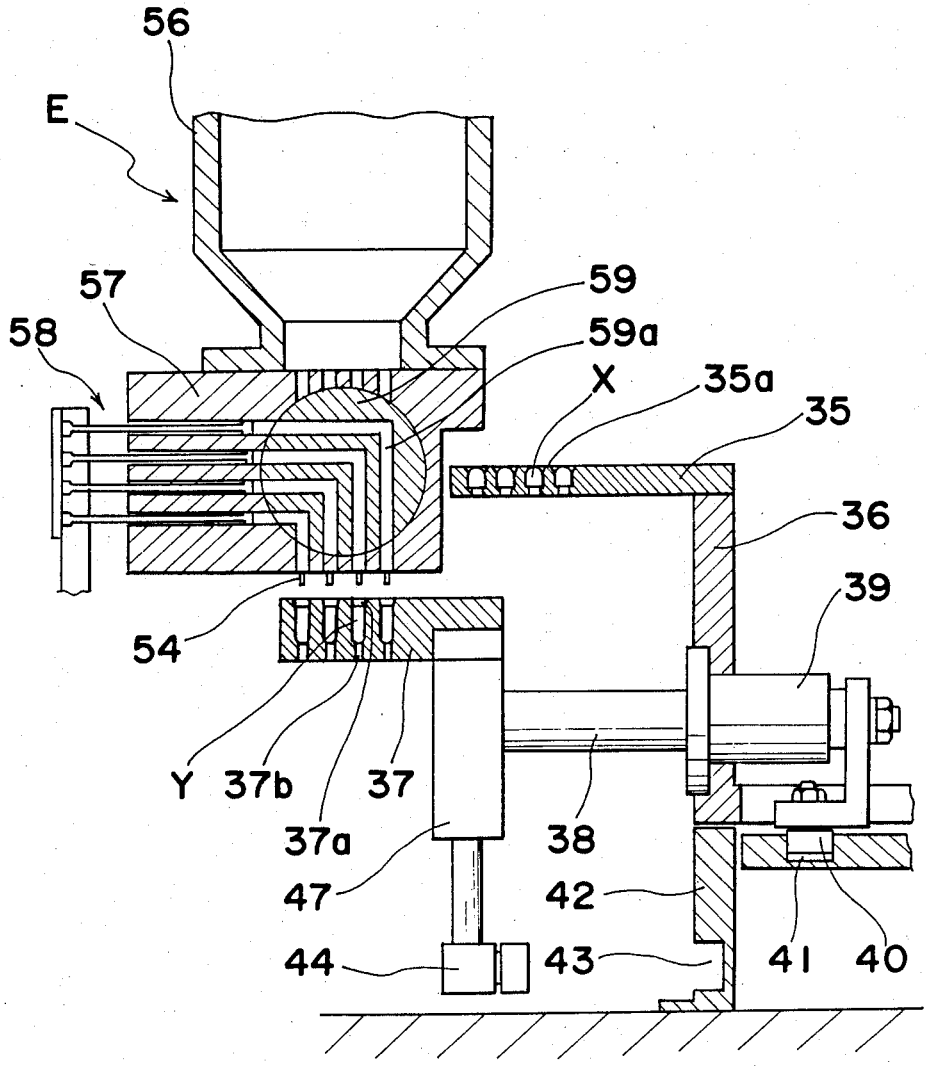
FIG. 13 is a view similar to FIG. 7, showing a constant quality fluid dispensing unit.

(3) Fluid Filling:

At the stations S4 and S5, the cup body carrier segment 37 is held at the lowered and radially outwardly projected position, as shown in FIGS. 3 to 6 and 13, in readiness for the filling of different fluid mediums, one medium at each station, into the cup bodies Y retained in the cup body receiving pockets 37a in each segment 37 then aligned with the stations S4 and S5 one at a time. For this purpose, as shown in FIG. 13, a constant quantity fluid dispensing unit E is disposed and arranged at each of the stations S4 and S5, although in place of the fluid dispenser unit E, any known powder filling mechanism may be employed.

Referring to FIG. 13, the illustrated dispenser unit E includes a hopper 56, a valve body 57, a metering unit 58, a valving member 59, and a plurality of dispensing nozzles 54. The valving member 59 has a plurality of L-shaped fluid passages 59a defined therein and is rotatable between a receiving position, in which the fluid medium within the hopper 56 flows into the passages 59a, and a dispensing position in which, as shown, the fluid medium within the passages 59a is dispensed through the nozzles 54 into the cup bodies Y carried by the carrier segment 37 and positioned therebelow.

It is to be noted that, if desired, one of the stations S4 and S5 may be omitted, or the number of the stations at which the filling is effected may be increased, depending on the number of kinds of the fluid mediums to be filled in the capsules.

(4) Capping:

The cap bodies which have been separated from the associated cup bodies at the station S1 as shown in FIG. 9 are, after the filling and at the stations S8 and S9, mounted on the associated cup bodies to produce the filled capsules now identified by FC in FIG. 14.

For this purpose, as shown in FIGS. 2 and 14, an arcuate depresser plate 60 is fixedly disposed at the stations S8 and S9 so as to overhang a portion of the outer periphery of the carrier disc 35, at which stations the neighboring carrier segments 37 are brought to the lifted and radially inwardly retracted position as seen from FIGS. 2 to 6 and 14. Cooperable with the depresser plate 60 is a lifting plate 61 supported below the segments 37 for movement between lifted and lowered positions in a direction close towards and away from the depresser plate 60, said plate 61 having a plurality of presser rods 62 which are rigidly mounted thereon and arranged in a pattern identical with the pattern of the cap body receiving pockets 35a in each group. The lifting plate 61 with the presser rods 62 thereon is essentially similar in structure to the ejector plate 52 with the knock-out pins 53 thereon.

Thus, it will readily be seen that, when the lifting plate 61 is moved from the lowered position, shown by the phantom line, towards the lifted position shown by the solid line, the presser rods 62 pass through the passages **37*b* and then lift from below the cup bodies Y which have been retained in the cup body receiving pockets 37*a* in each of the carrier segments 37 and have been filled with the fluid medium such as, for example, oil paste or slurry. As the lifting plate 61 is further moved towards the lifted position, the filled cup bodies Y are lifted and subsequently received in the associated cap bodies X, then received in the cap body receiving pockets 35*a*, while the latter are retained in position by the depresser plate 60** positioned immediately thereabove. When the cap bodies X are mounted on the associated cup bodies Y, the capsules are completely closed or locked, in contrast to the prelocked condition in which each cap body can be readily removed from the respective cup body.

While only the station S8 may be enough for the capping procedure, the capping performed at the station S9 ensures that all of the filled capsules FC are completely closed.

(5) Ejection:

At the subsequent station S10, the filled capsules FC substantially carried by the carrier disc 35 are removed from the carrier disc 35 and from the capsule filling unit.

Figure 15:
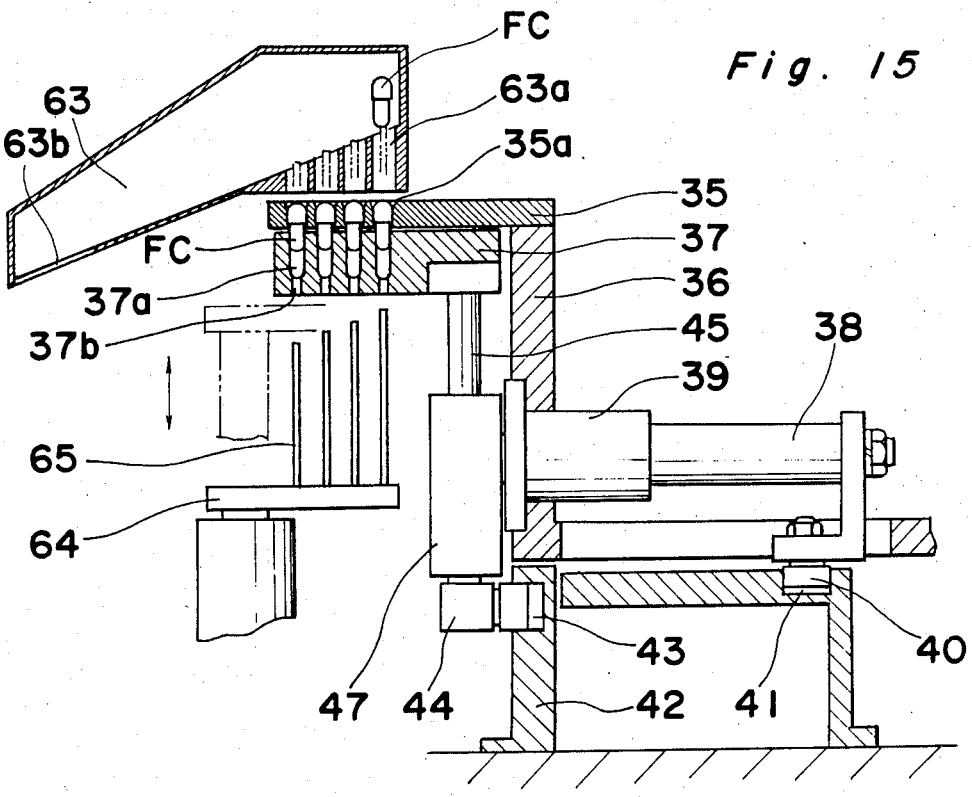
FIG. 15 is a view similar to FIG. 7, showing an ejecting unit for collecting the filled capsules.
Figure 16:
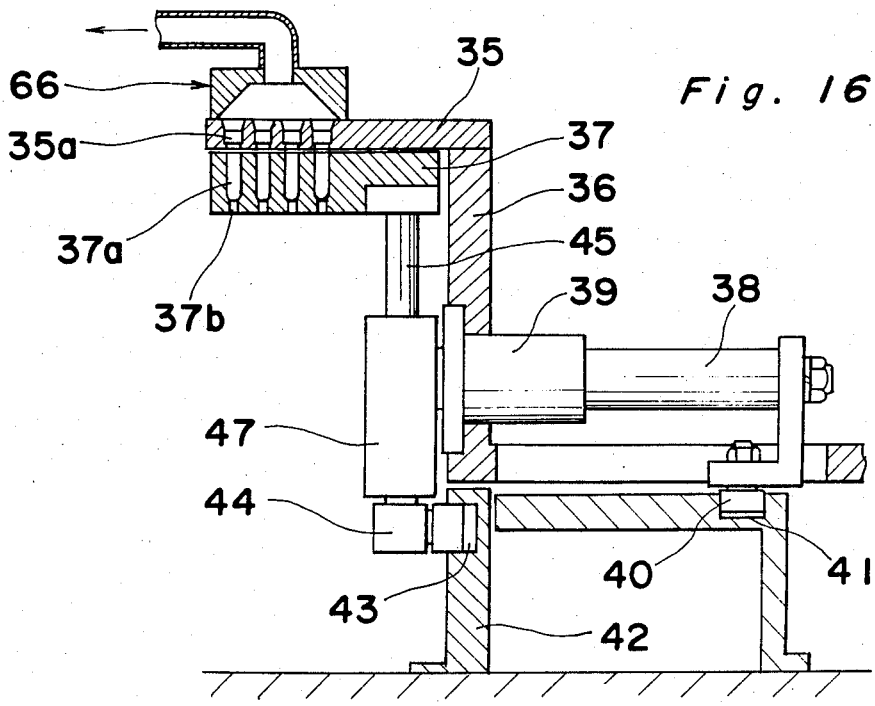
FIG. 16 is a view similar to FIG. 7, showing a cleaning unit.

Referring to FIG. 15, the capsule ejecting unit E is disposed at the station S10, which includes a chute 63 having a plurality of holes **63*a* defined therein in a pattern identical with that of the cap body receiving pockets 35*a* in each group, an ejector plate 64 supported below the carrier segment 37, then brought to the station S10 and held in the lifted and radially inwardly retracted position, for movement between inoperative and ejecting positions, and a plurality of ejecting pins 65 rigidly mounted on the ejector plate 64 in alignment with the respective passages 37*b* communicated with the cup body receiving pockets 37*a***.

The chute 63 is of a generally elongated box-like configuration having its inclined bottom formed at one end with the holes **63*a* and at the other end with a discharge opening 63*b*. In view of the bottom of the chute 63 inclined relative to the carrier disc 35, the holes 63*a* have progressively decreasing depths from the outermost row of the holes 63*a* which align with the innermost row of the cap body receiving pockets 35*a* in each group in the carrier disc, and in correspondence thereto, the ejecting pins 65** have progressively decreasing lengths as shown.

Thus, it is clear that, when the ejector plate 64 is moved from the lowermost position to the lifted position by a suitable drive (not shown), the filled capsules FC retained in the cap body receiving pockets **35*a* in each group are popped up by the ejecting pins 65 into the interior of the chute 63, which subsequently fall by gravity towards the discharge opening 63*b* along the inclined bottom. The filled capsules FC discharged from the discharge opening 63*b*** may be conveyed to a packaging machine.

(6) Cleaning:

The group of the cap body receiving pockets **35*a* and its associated carrier segment 37 are, after the filled capsules FC have been removed therefrom at the ejecting station S10, transferred to the cleaning station S11 at which a suction cup 66 is aligned with such group of the cap body receiving pockets 35*a* to effect a vacuum cleaning of the pockets 35*a* and 37*a*** in readiness for the next cycle of empty capsule loading.

III. Dispensing Unit

Figure 17:
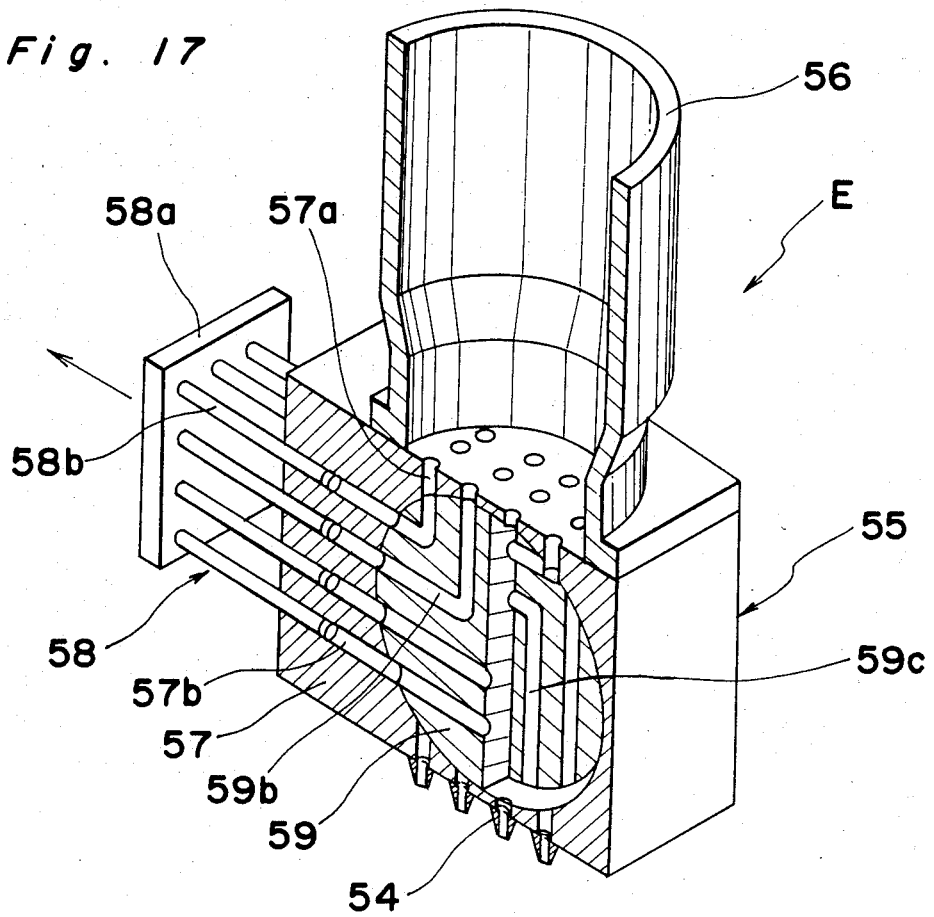
FIG. 17 is a perspective view, with a portion cut away, showing a constant quality fluid dispensing unit in one operative position.
Figure 18:
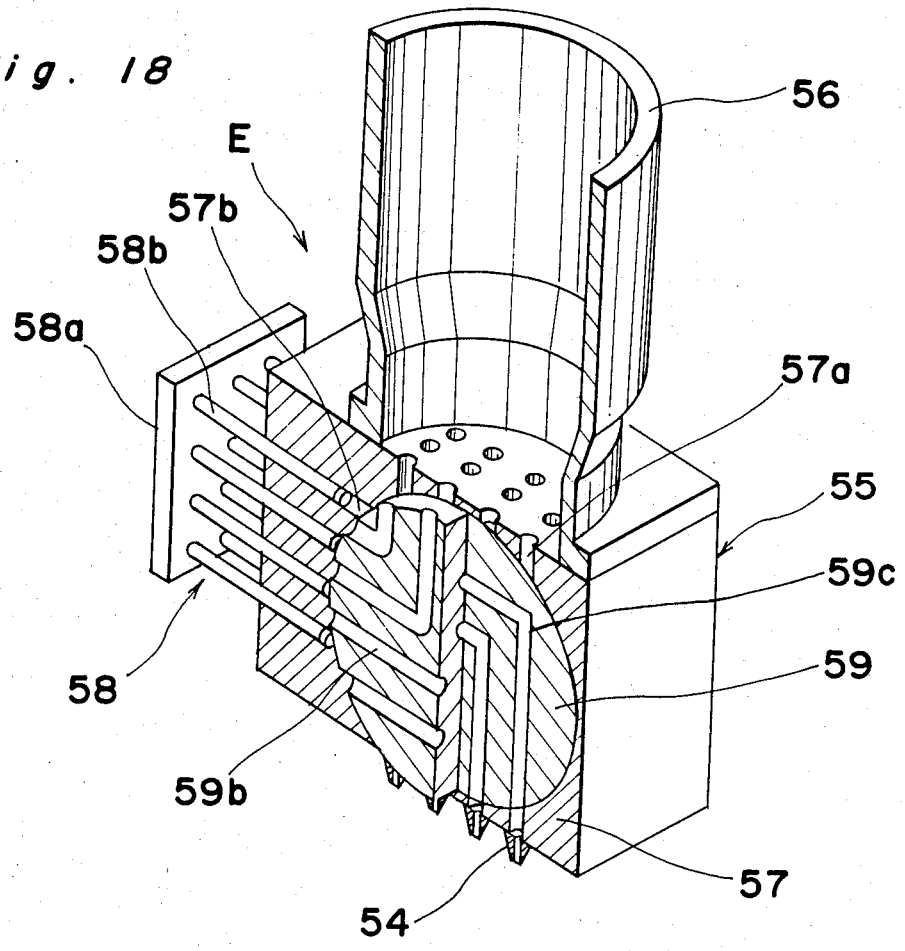
FIG. 18 is a view similar to FIG. 17, showing the dispensing unit in another operative position.

The details of the fluid dispenser unit E are illustrated in FIGS. 17 and 18. The dispenser unit E comprises a valve assembly 55 including a housing block 57 having a valving member 59, displaceably housed therein, and also having a pumping unit 58 built-therein. Mounted atop the housing block 55 is a hopper 56 for accommodating a quantity of fluid medium to be filled in each capsule. On one side of the valve assembly 55 opposite to the hopper 56, the housing block 57 has a plurality of injecting nozzles 54 for dispensing quantities of the fluid medium into the cup bodies Y then retained by the particular cup body carrier segment 37. Positioned laterally of the valve assembly 55 is a plunger block **58*a***.

In the illustrated condition of FIG. 17, the valving member 59 is held in a metering position in which a plurality of generally L-shaped passages **59*b* defined in the valving member 59 communicate respective passages 57*a*, defined in the housing block 57 in communication with the hopper 56, with passages 57*c* also defined in the housing block 57 in communication with the pumping unit 58. The pumping unit 58 includes plungers 58*b* equal in number to the passages 57*b* and axially slidably inserted at one end into these passages 57*b* and rigidly connected at the other with the plunger block 58*a*. Therefore, when the valving member 59 is in the metering position shown in FIG. 17, and when the plunger block 58*a* is displaced in a direction shown by the arrow, the fluid medium within the hopper 56 is sucked and stored in the passages 57*b* in a predetermined quantity determined by the displacement of the plunger block 58*a***.

It is to be noted that the valving body 59 having the passages **59*b* defined therein also has defined therein an equal number of generally L-shaped passages 59*c* which are, when the valving body 59 is in the metering position as shown in FIG. 17, completely closed by the wall of the housing block 57 around the valving body 59** while containing therein the fluid medium which has been previously supplied.

The valving body 59 is displaceable in a direction parallel to the axis of rotation thereof between the metering position shown in FIG. 17 and a dispensing position shown in FIG. 18, over a predetermined distance equal to the sum of the diameter of each of the passages **59*b* and the space between each neighboring passages. Therefore, when the valving body 59 held in the metering position is displaced to the dispensing position shown in FIG. 18, the passages 59*c* are brought in position to communicate the passage 57*b* with the nozzles 54 therethrough while the passages 59*b* are completely closed by the wall of the housing block 57 around the valving body 59**.

When the plunger block **58*a* is moved in a direction counter to the direction shown by the arrow, i.e., close towards the valve assembly 55 while the valving body 59 is held in the dispensing position, the fluid medium which has been previously primed into the passages 59*c* can be discharged through the dispensing nozzles 54 in a quantity equal to that injected thereinto from the passages 57*b* as a reslt of the displacement of the plunger block 58*a***.

Preferably, the plunger block **58*a* has a plurality of adjustable positions over the maximum available stroke thereof, in combination with a position adjustment which may be comprised of a positive motion cam mechanism, so that the quantity of the liquid medium dispensed into each capsule can be controlled dependent on the position of the plunger block 58***a*.

Figure 19:
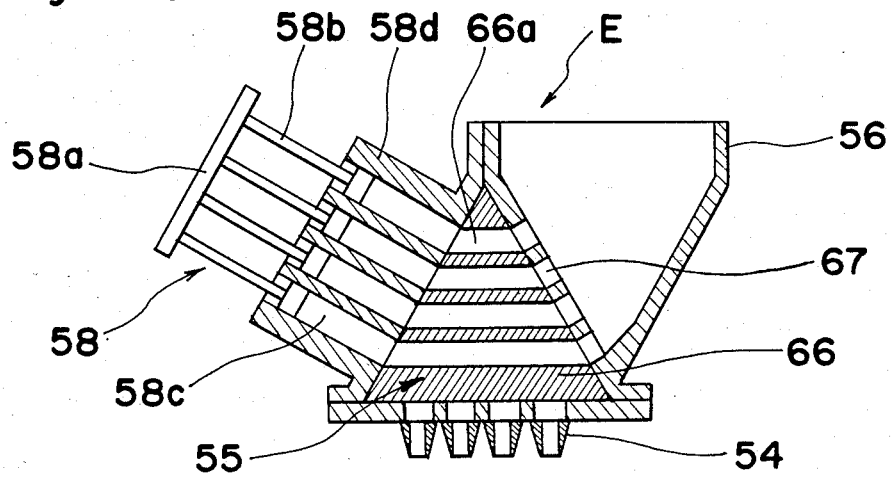
FIGS. 19 and 20 are sectional views of a modified form of the dispensing unit in different operative positions, respectively.
Figure 20:
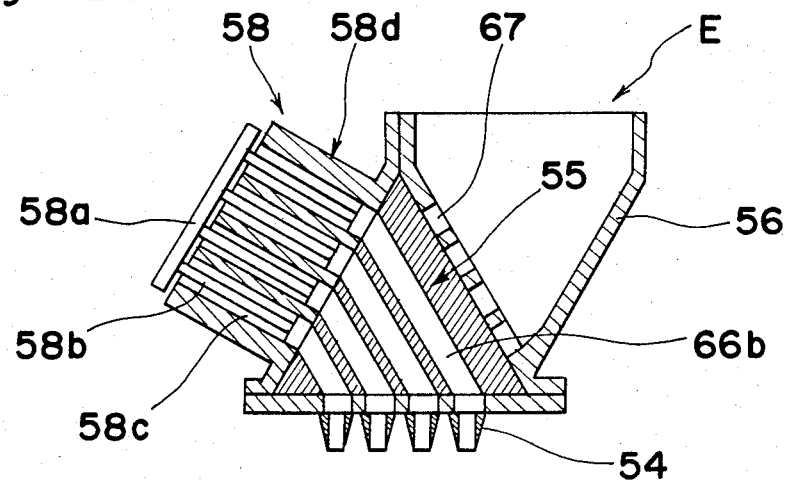

FIGS. 19 and 20 illustrate a modified form of the valve assembly 55. In this modification, the valve assembly 55 employs a generally triangular cross-sectioned valving body 66 having two groups of straight passages defined therein, one group of the passages being identified generally by 66*a* in FIG. 19 whereas the other group of the passages is identified generally by 66*b* in FIG. 20. This valving body 66 is displaceable between the metering and dispensing positions in a direction perpendicular to the plane of the drawing of FIG. 19, and when in the metering position as shown in FIG. 19, the valving body 66 allows the passages 66*a* to communicate between ports 67, defined in a bottom wall of the hopper 56 which concurrently forms a part of the housing for the valve assembly 55, and cylinders 58*c* of a cylinder assembly 58*d* which concurrently forms another part of the housing for the valve assembly 55 and into which the plungers 58*b* extend axially slidably. However, when the valving body 66 is displaced to the dispensing position as shown in FIG. 20, the cylinders 58*c* in the cylinder assembly 58*d* are communicated with the nozzles 54 through the passages 66*b*. The adjustment of the quantity of the fluid medium to be dispensed into the cup body of each capsule can be achieved in the same way as that described with reference to FIGS. 18 and 19.

The valve assembly 55 of the construction shown in and described with reference to FIGS. 19 and 20 is particularly advantageous in that the resistance to the flow of the fluid medium from the hopper 56 to the pumping unit 58 and also from the pumping unit 58 to the nozzles 54 can be minimized because of the employment of the straight passages 66*a* and 66*b*.

Figure 21:
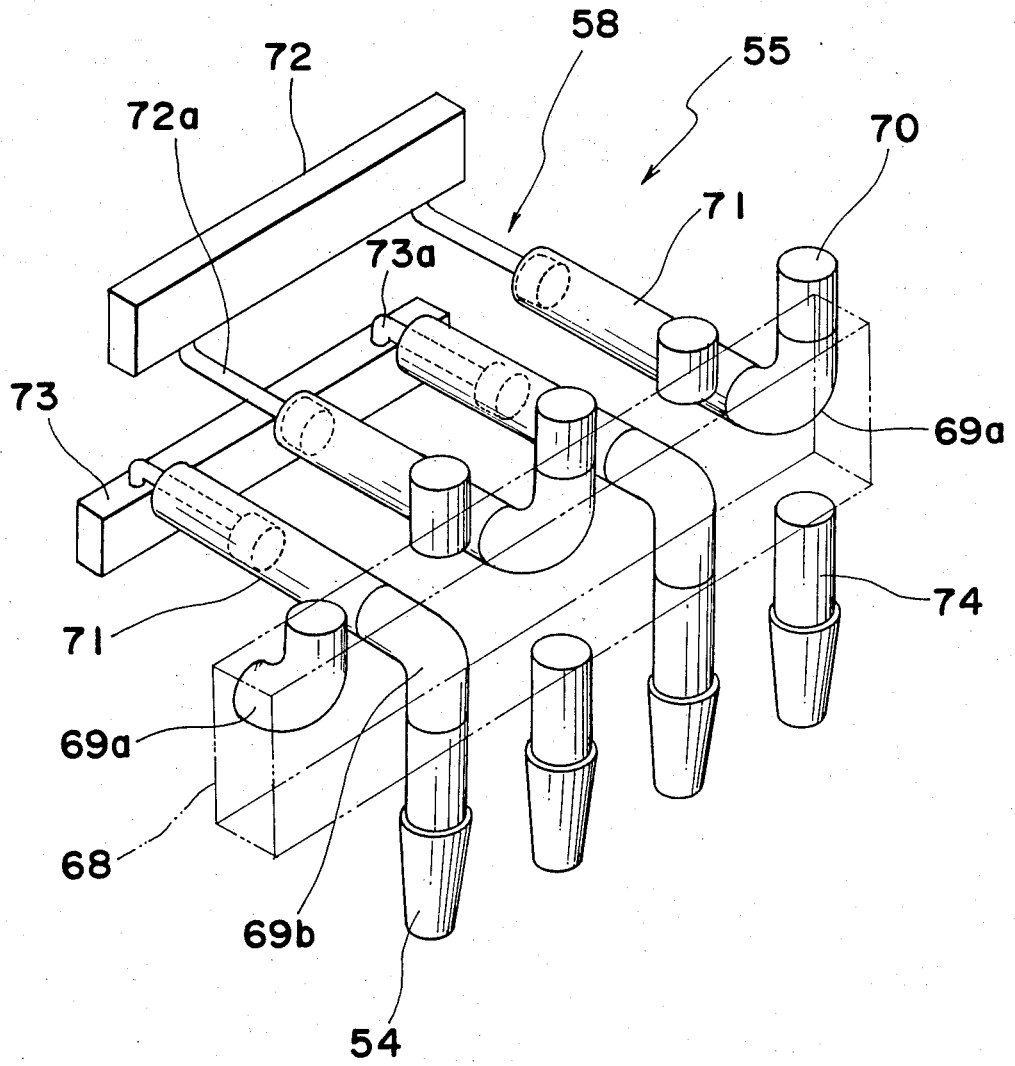
FIG. 21 is a skeleton diagram showing a further modified form of the dispensing unit.

A further modified form of the valve assembly 55 is shown in FIG. 21, in which only a skeleton of passages is shown for the sake of brevity. The valve assembly shown therein comprises a generally rectangular valving body shown by the phantom line 68 and movable between first and second positions in a direction longitudinally thereof. The valving body 58 has a group of a plurality of, for example, three, generally L-shaped passages 69*a* each having one end communicated through a respective tube 70 with the hopper and the other end adapted to be communicated with a respective cylinder 71 of the pumping unit 58, and another group of L-shaped passages 69*b* each having one end adapted to be communicated with the respective cylinder 71 and the other end adapted to be communicated through a respective tube 74 with the respective nozzle 54, all of said passages 69*a* and 69*b* being defined in the valving body 68 in equally spaced relationship with each other.

The pumping unit 58 shown therein comprises two separate plunger blocks 72 and 73 each having a plurality of, for example, two plungers 72*a* or 73*a* axially slidably inserted into the respective cylinders 71. The plunger blocks 72 and 73 are alternately driven so that, when the valving body 68 is in the first position, the fluid medium can be sucked from the hopper through the two passages 69*a* into the two cylinders 71 associated with the cylinder block 72 and, at the same time, the fluid medium filled in the other two cylinders 71 associated with the plunger block 73 can be purged into the passages 69*b* and then discharged through the respective nozzles 54. Even when the valving body 68 is moved to the second position, the pumping and discharge of the fluid medium takes place in a manner similar to that described above because of the plunger blocks 72 and 73 being alternately moved in unison with the movement of the valving body 68.

It is to be noted that each of the nozzles 54 has a discharge port of a diameter so selected as to be smaller than the bore of each tube 74 wherefore any possible change in quantity of the fluid to be dispensed which would occur as a result of leakage of the slurry can be advantageously minimized.

IV. Powder Filling Machine

Figure 22:
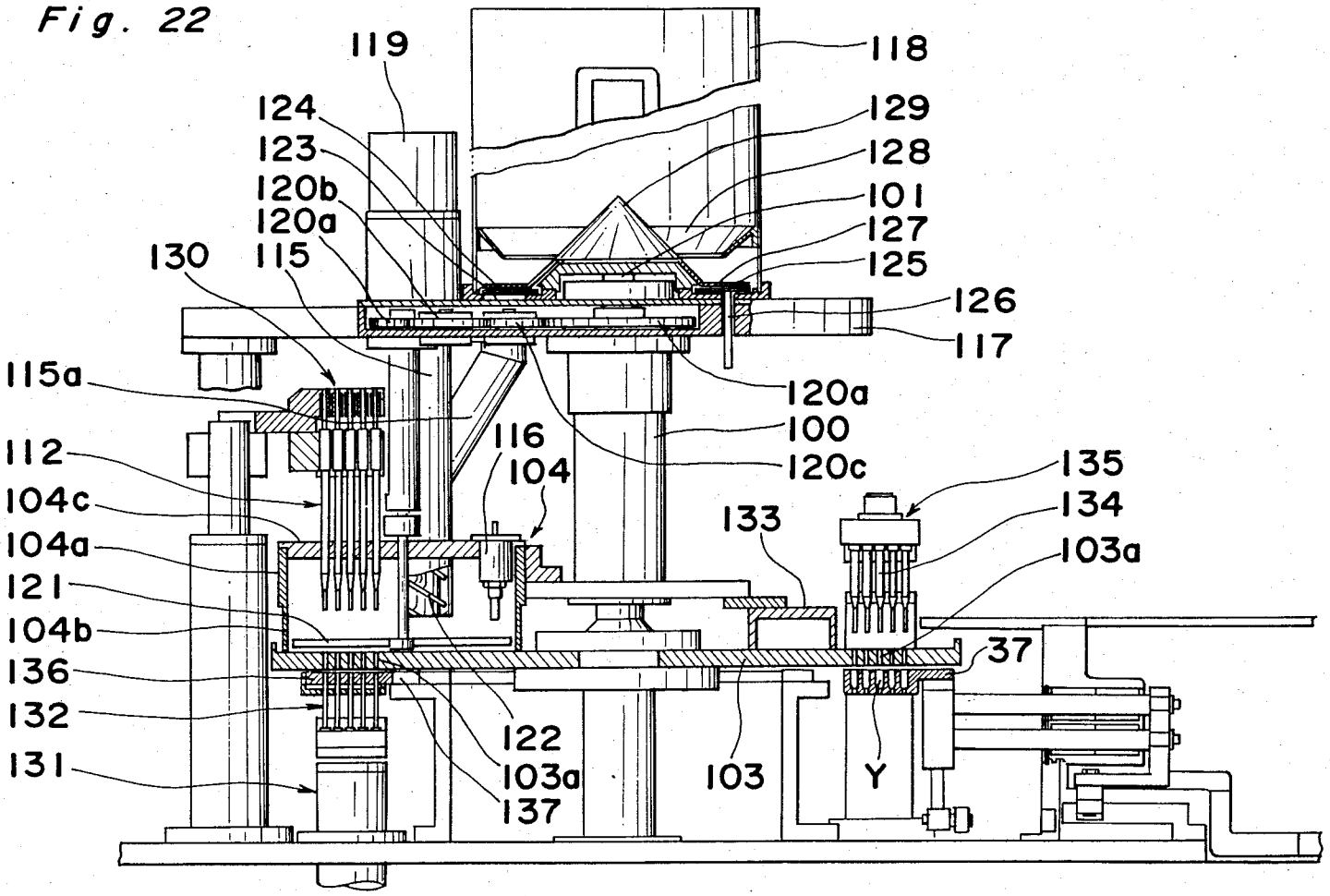
FIG. 22 is a side view, with a portion shown in section, of a powder filling machine according to the present invention.
Figure 23:
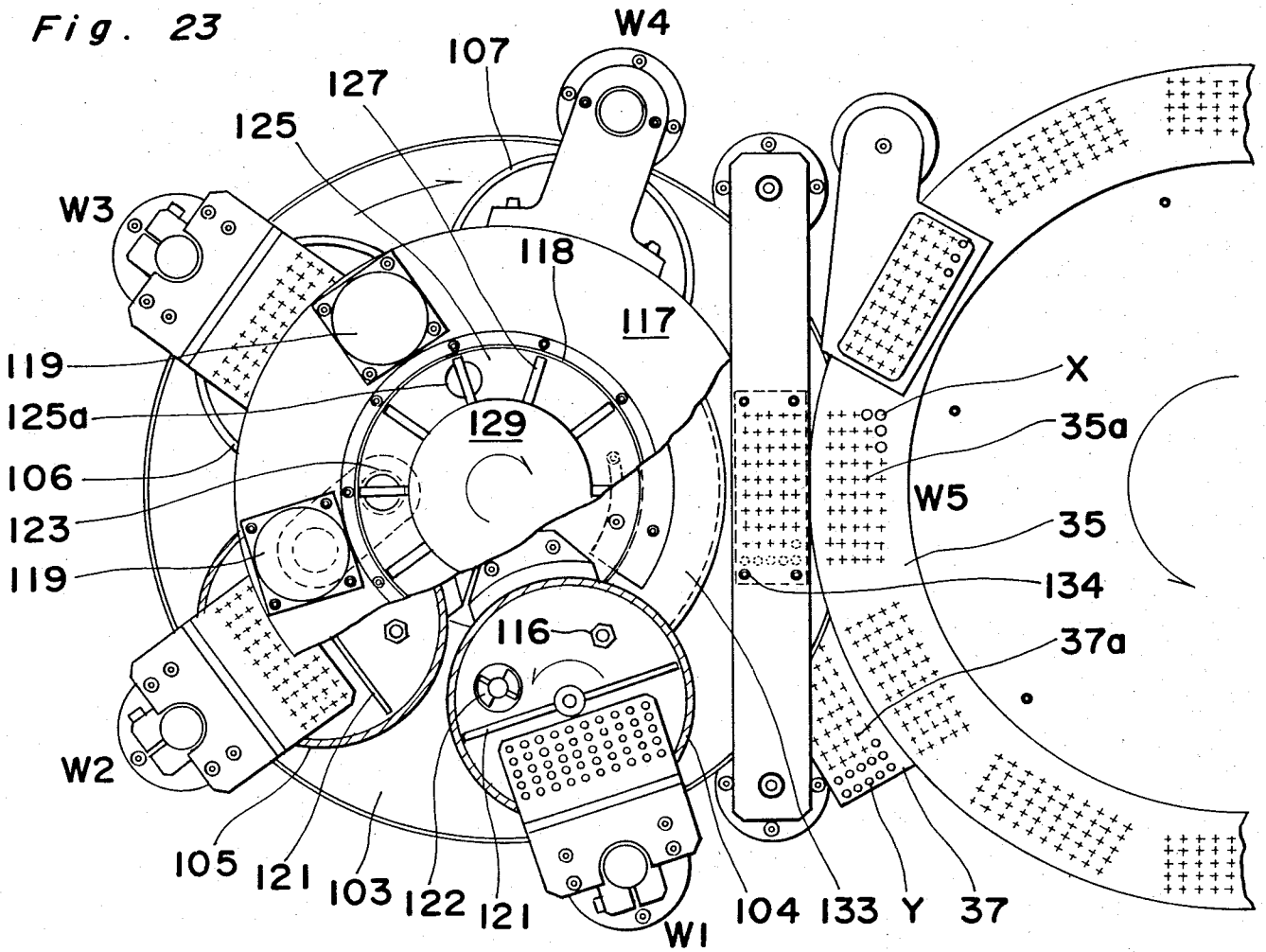
FIG. 23 is a top plan view, on an enlarged scale and with a portion cut away, of a portion of the powder filling machine.

Referring to FIGS. 22 and 23, a powder filling machine according to the present invention comprises a support column 100 supporting a rotary shaft 101 on which a metering disc 103 is mounted for intermittent rotation past a plurality of work stations disposed adjacent the outer periphery of the disc 103. These work stations include compressing stations W1, W2 and W3, a metering station W4 and a delivery station W5 which are spaced an equal distance from each other in a direction circumferentially of the metering disc 103. Cylindrical hoppers 104, 105, 106 and 107 each having the bottom served by the top surface of the disc 103 are fixedly supported above the disc 103 in alignment with the work stations W1 to W4. The hoppers 104 to 107 are of identical construction and, therefore, only one of which, for example, the hopper 104, will be described. The hopper 104 (105, 106 or 107) in in the form of a top-closed cylindrical hollow body having a cylindrical side wall 104*a* (105*a*, 106*a* or 107*a*) having a lower open end provided with a skirt 104*b* (105*b*, 106*b* or 107*b*), which skirt protrudes downwards therefrom and terminates at a position spaced a predetermined distance, for example, about 0.1 mm, from the top surface of the disc 103. The hopper 104 (105, 106 or 107) also has a lid 104*c* (105*c*, 106*c* or 107*c*) mounted atop the cylindrical side wall 104*a* (105*a*, 106*a* or 107*a*). It is to be noted that the skirt 107*d* of the hopper 107 positioned in alignment with the metering station W4 serves as a doctor blade. The lid 104*c* (105*c*, 106*c* or 107*c*) has a bearing hole defined therein coaxially for the support of a stirrer shaft 108 (109, 110 or 111).

Each of the lids 104*c*, 105*c* and 106*c* of the hoppers 104, 105 and 106 positioned in alignment with the compressing stations W1 to W3 has defined therein a plurality of, for example, 50, holes for the passage therethrough of an equal number of presser rods generally identified by 112, 113 or 114, a port for receiving a powder supply tube 115 and a bearing hole for the support of a respective level sensor 116.

The central support column 100 supports a plate-like upper transmission box 117 from below, on which box 117 is mounted a master hopper 118 and a powder supply motor 119 for each supply tube 115.

Within the transmission box 117, a gear train including gears 120*a*, 120*b*, 120*c* and 120*d* is accommodated for controlling the synchronized rotation of the metering disc 103 and the stirrer shafts 108, 109, 110 and 111 in the opposite directions with respect to each other. Each of said stirrer shafts 108 to 111 has its lower end to which a stirrer blade assembly 121 is secured.

Within each of the powder supply tubes 115 communicated with the respective hoppers 104, 105 and 106, there is disposed a feed screw 122 adapted to be driven by the respective powder supply motor 119 through one or more gears. Each of the powder supply motors 119 is controlled in response to an electric signal generated from the associated level sensor 116.

Each of the powder supply tubes 115 has a branch tube 115*a* branched from a substantially intermediate portion thereof so as to extend diagonally upwards and communicated with the master hopper 118. At the joint between the two, there is a respective opening 123 defined in a bottom plate 124.

Each of the openings 123 is adapted to be selectively closed and opened by an annular shutter plate 125 overlapping with the bottom plate 124. By manipulating a shutter level 126 extending vertically through the transmission box 117, the extent to which the openings 125*a* defined in the shutter plate 125 overlap with the openings 123 in the bottom plate 124, respectively, can be adjusted between a closed position and fully opened position. Immediately above the shutter plate 125, there is disposed a rotary stirrer blade assembly 127 rotatable about the disc support shaft 101.

Thus, the powder falling downwards by gravity within the master hopper 118 is stirred centripetally and then centrifugally because of the presence of a downwardly converging baffle 128 integral or rigid with a lower end of the wall of the hopper 118 and conical cap 129 covering the top of the disc support shaft 101, and thereafter falls onto the shutter plate 125. The powder so supplied onto shutter plate 125 is then guided towards and distributed into the branch tubes 115*a* by the motion of the blade assembly 127 without any bridging phenomenon.

Fixed portions above and below the metering disc 103 support four drive control means for the presser rods 112, 113 and 114 positioned in alignment with the respective stations W1 to W4, and two drive control means 131 for auxiliary presser rods 132 positioned in alignment with the respective stations W1 and W4, respectively.

As will be described in detail later, at the metering station W4, an excessive portion of each compressed mass or pellet P (FIG. 24) of the powder is removed and, therefore the removed excessive portions of the pellets P will gather within the metering hopper 107 in the form of slag. These slags are recovered into the distributing hopper 104 for reuse as the powder. For this purpose, a transfer means is provided between the metering hopper 107 and the distributing hopper 104, bypassing the delivery station W5.

In the illustrated embodiment, the transfer means is comprised of a generally sector-shaped covering 133 of generally U-shaped cross-section opening towards, and substantially closed by, the metering disc 103, which covering 133 extending arcuately between the metering hopper 107 and the distributing hopper 104. In this construction, when the blade assembly 121 rotating within the metering hopper 107 brings the powder slag to the entrance leading to the covering 133, the powder slag resting on the metering disc 103 then rotating in one direction shown by the arrow in FIG. 23, is transported through the covering 133 towards the distributing hopper 104.

At the delivery station W5, the pellets P contained in respective metering cavities 103*a* defined in the metering disc 103 are pressed downwards into the respective cup bodies Y, positioned therebelow, by the descending motion of the delivery plungers 134 driven by a delivery plunger drive means 135. The capsule cup bodies Y filled with the respective pellets P are subsequently delivered in any known manner to a capping machine by which the capsule cap bodies are mounted to provide the filled capsules.

The operation of the powder filling machine of the construction described with particular reference to FIGS. 22 and 23 wil now be described with reference to FIG. 24 which illustrates the principle thereof for the sake of clarity.

Figure 24:
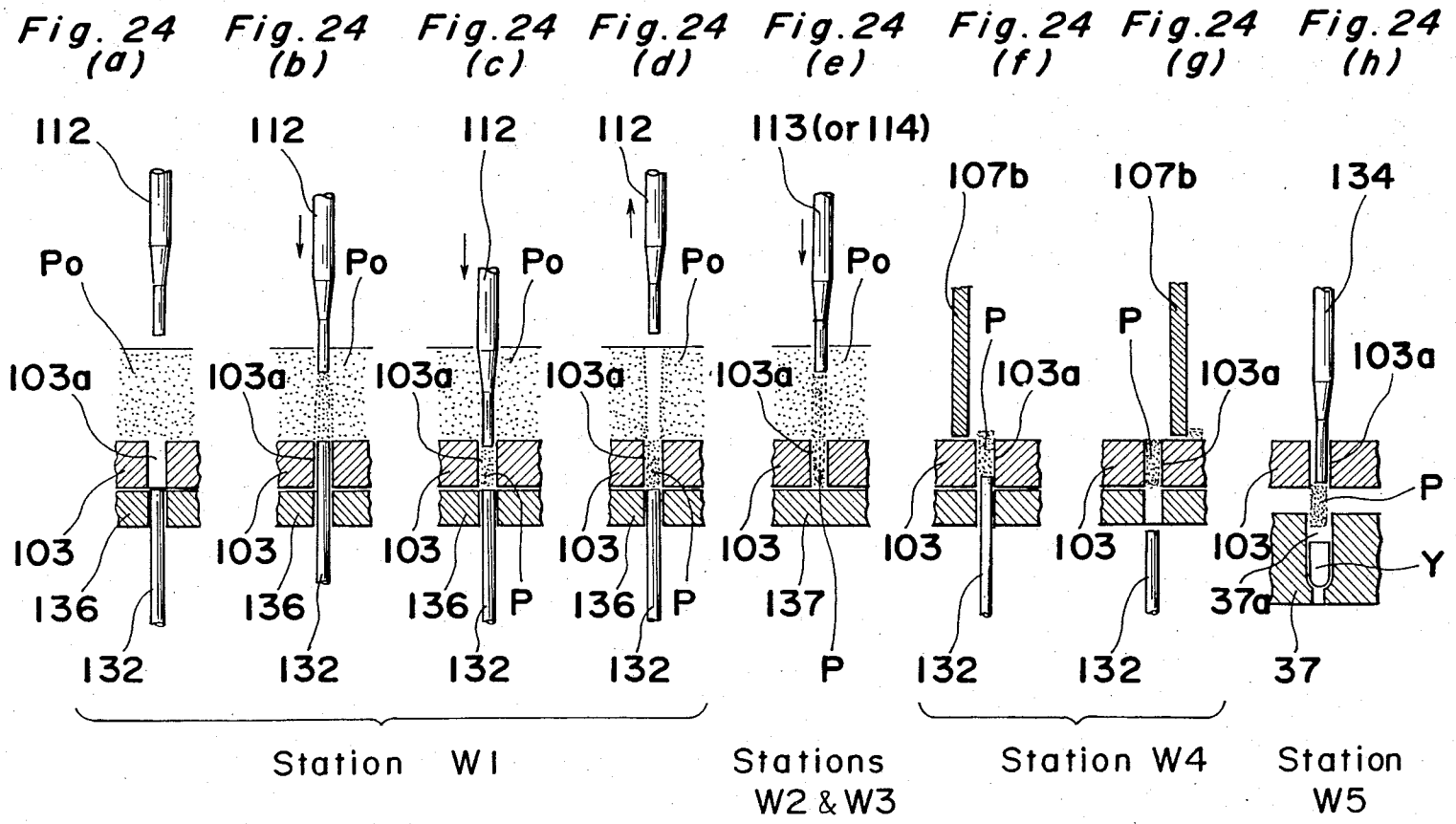
FIGS. 24(*a*) to 24(*h*) are schematic diagrams showing the sequence of powder filling performed by the powder filling machine.

Referring first to FIG. 24(*a*), a layer of powder identified by Po and deposited on the meteriing disc 103 is sucked into the metering cavities 103*a* to fill up the latter at the compressing station W1. This takes place as the auxiliary presser rods 132 then projecting into the respective metering cavities 103*a* are retracted downwards inducing a negative pressure inside the metering cavities 103*a* for sucking the powder Po into the metering cavities 103*a*. While the auxiliary presser rods 132 are held in position to close the bottom openings of the respective cavities 103*a*, the presser rods 112 are driven downwards to ram the masses of the powders within the metering cavities 103*a* as shown in FIG. 24(*b*) to provide the compressed masses of powder, that is, the pellets P as shown in FIG. 24(*c*). During the formation of the pellets P, the masses of powder within the cavities 103*a* are compressed to such an extent that, even though the presser rods 112 and 132 are upwardly and downwardly retracted away from the cavities 103*a*, the resultant pellets P can support themselves within the cavities 103*a* with no possibility of falling downwards by gravity as shown in FIG. 24(*d*). The auxiliary presser rods 132 are subsequently further retracted downwards to a position where they will not provide an obstruction to the rotation of the metering disc 103. It is to be noted that reference numeral 132 represents a perforated rod guide provided underneath the disc 103.

Ramming of the compressed powder masses P within the cavities 103*a* is also effected in a similar manner even at each of the compressing stations W2 and W3 by means of the presser rods 113 or 114 as shown in FIG. 24(*e*). However, at each of the stations W2 and W3, instead of the auxiliary presser rods 132 cooperable with the presser rods to compress the powder masses, a back-up plate 137 is employed to support from below the powder masses P being rammed by the presser rods 113 or 114. This back-up plate 137 may be an imperforated integral extension of the rod guide 136.

At the metering station W4, the auxiliary presser rods 132 are upwardly shifted a predetermined distance to push the pellets P within the metering cavities 103*a* to such an extent as to allow head portions of the pellets P to be exposed from the metering cavities 103*a* as shown in FIG. 24(*f*). This predetermined distance over which the auxiliary presser rods 132 at the metering station W4 are upwardly shifted is so selected that that portion of each pellet P which remains within the respective metering cavity 103*a* corresponds to a predetermined or required amount of the powder to be filled in each capsule. Accordingly, if each powder mass within the respective cavity 103*a* has been compressed sufficiently so as to have a controlled height corresponding to the required amount of the powder to be filled in each capsule, the head portion thereof will not expose above the disc 103 even when the associated presser rod 132 has been shifted the predetermined distance upwardly. However, should the head portions of the pellets P come out of the respective metering cavities 103*a* as shown in FIG. 24(*f*), those head portions of the pellets P are subsequently scraped off by the skirt 107*b* integral or rigid with the lower end of the metering hopper 107 as shown in FIG. 24(*g*), thereby producing powder slags which are then guided towards the distributing hopper 104 through the tunnel-like covering 133.

After the presser rods 132 at the metering station W4 have been retracted, the metered pellets P are transferred to the delivery station W5 as a result of the intermittent rotation of the disc 103. At this delivery station W5, the delivery plungers 134 are lowered to project into the cavities 103*a* while pushing the pellets P downwards into the capsule cup bodies Y supported in the respective cup body receiving pockets in the associated carrier segment 37 as shown in FIG. 24(*h*).

The powder filling machine of the construction described with reference to an shown in FIGS. 22 to 24 employs a metering system wherein the amount of the powder to be filled in each capsule is metered by forming a column of the powder and then scraping an excessive portion of the powder column. Therefore, unlike the conventional metering system utilizing pressure, the quantitative adjustment of the powder and the changeover can readily be performed. Moreover, the adjustment of the compressed masses of powder resulting from the difference in apparent specific gravity of the powder can also be achieved not only during the operation of the machine, but also during the inoperative condition.

Furthermore, since the separate distributing and metering hoppers are employed to effect the stirring of the respective masses of the powder at different places, no bias will occur in composition of the powder where the powder consists of a plurality of ingredients mixed together.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A powder filling machine for filling a powdery material into a capsule, which comprises a metering disc mounted on a vertical shaft, a plurality of work stations situated around said metering disc, means for intermittently rotating said metering disc about said vertical shaft past said work stations, said metering disc having a plurality of groups of metering cavities, the number of said cavity groups corresponding to the number of said work stations, a first one of said work stations being a compressing station, said compressing station including presser rods and means to move said presser rods up and down, said presser rods each are engageable in a respective cavity of said metering cavities and have an outer diameter appropriate to the diameter of said respective cavity, so that the powdery material is compressed within said cavities to provide pellets by the up and down movement of said presser rods, a second one of said work stations being a delivery station, a delivery plunger for each of said cavities is located at said delivery station, means for positioning a capsule cup body below said delivery plunger, means for lowering each said delivery plunger to press the respective pellet to fall into said capsule cup body positioned therebelow, means for subsequently delivering said capsule cup body to an associated apparatus, a first auxiliary presser rod for each said cavity, each said first auxiliary presser rod being located at a first stage of said compressing station, and having an outer diameter appropriate to the diameter of each said respective cavity, each said respective cavity having a bottom opening therein, means for inserting said first auxiliary presser rod from below into said respective cavity through said bottom opening, so as to occupy the entire space inside said respective cavity, means for lowering said first auxiliary presser rod to allow a layer of the powdery material formed on said metering disc to be drawn into said respective cavity to fill up said respective cavity, a third one of said work stations being a metering station located between a final stage of said compressing station and said delivery station, a second auxiliary presser rod, for each said respective cavity, located at said metering station, each said second auxiliary presser rod having an outer diameter appropriate to the diameter of each said respective cavity, means for inserting each said second auxiliary presser rod into said respective cavity through said bottom opening of said cavity to push a respective pellet upwards to such an extent that in the event that said pellet is of a quantity exceeding a predetermined value, an excessive portion of said pellet will be exposed above said metering disc, and means provided at said metering station for scraping off any excessive portion of the pellet.

2. The apparatus as claimed in claim 1, wherein each of said compressing station and said metering station is covered by an immovable closed vessel having its bottom served by a surface of said metering disc, and wherein said vessel has provided therein a stirring means effective to stir the layer of powdery material on said metering disc surface.

3. The apparatus as claimed in claim 2, wherein said closed vessel comprises a closed side wall having a skirt contacting said surface of said metering disc while permitting the rotation of said metering disc, and a lid having defined therein a hole for accommodating at least one of said presser rods, a powdery material supply tube, a shaft for said stirring means and a level sensor.

4. The apparatus as claimed in claim 3, wherein said closed vessel is a hollow cylindrical body coaxial with said shaft for said stirring means and wherein said stirring means comprises a stirring blade assembly mounted on said shaft, means for rotating said stirring blade assembly in the vicinity of the surface of the metering disc in a direction counter to the direction of rotation of the metering disc, said stirring blade assembly having a size conforming to the shape of a circle defined by said closed side wall.

5. The apparatus as claimed in claim 3, wherein said scraping means is constituted by said skirt of said closed vessel disposed at said metering station.

6. The apparatus as claimed in claim 1, wherein said first and second auxiliary presser rods, said means for moving said first auxiliary presser rods and said means for moving said second auxiliary presser rods are positioned below said metering disc.

7. The apparatus as claimed in claim 2, further comprising a guide means disposed so as to extend between said closed vessels at said metering station and said compressing station, respectively, by way of said delivery station for transferring the powdery material from said closed vessel at said metering station to said closed vessel at said compressing station.

8. The apparatus as claimed in claim 7, wherein said guide means comprises a closed tunnel having its open ends opening into the respective closed vessels through their closed side walls, said tunnel extending arcuately therebetween and covering a portion of said metering disc radially inwardly of said delivery station.

9. The machine as claimed in claim 1 further including a capsule rectifying apparatus which comprises a hopper for accommodating capsules, each capsule comprised of a cup body and a cap body exteriorly mounted on the cup body, in an arbitrary posture; a supply drum rotatably supported below said hopper for rotation in a first direction about a horizontal axis and having its outer peripheral surface formed with a plurality of radially inwardly recessed supply pockets for receiving therein the capsules in any arbitrary posture from said hopper, said supply pockets being arranged in at least one circumferentially extending row in equally spaced relation to each other, said supply drum being operable to transport the capsules received in the corresponding supply pockets from the hopper to a first transfer station; a rectifying drum supported immediately beneath said supply drum for rotation in a second direction counter to said first rotational direction, said rectifying drum having its outer peripheral surface divided into perforated and solid zones which alternate with each of said zones being of equal length in a circumferential direction, said perforated zones of said outer peripheral surface of said rectifying drum being formed with a circumferentially extending row of radially inwardly recessed rectifying pockets for receiving therein the capsules from said supply drum at said first transfer station, means is provided for rotating said rectifying drum at the same peripheral velocity as that of said supply drum for transporting the capsules received in said rectifying pockets in each perforated zone to a second transfer station, each of said rectifying pockets in all of said perforated zones being comprised of a radial pocket portion shaped to receive therein the cup body of each capsule and a circumferential pocket portion lying in a direction circumferentially of said rectifying drum and generally perpendicular to the associated radial pocket portion, said circumferential pocket portion being so sized as to accommodate each capsule in a laid-down position, whereby when each of the capsules successively transferred from the supply drum onto the rectifying drum is in a bottom-capped position, the cup body of such capsule is received in the respective radial pocket portion with the cap body situated completely within the associated rectifying pocket, but when one of such capsules is in a top-capped position, the cap body of such capsule rests on the opening leading to the respective radial pocket portion with the cup body thereof protruding radially outwardly from the associated rectifying pocket, said first and second transfer stations being spaced 180° from each other about the axis of rotation of said rectifying drum; a barrier member fixedly supported adjacent said rectifying drum for engagement with the cup bodies of the capsules received in the respective rectifying pockets in the bottom-capped position, said capsules in the respective rectifying pockets being, during the transportation thereof from said first transfer station towards said second transfer station, positioned within the respective circumferential pocket portions when the cup bodies located therein are successively brought into engagement with said barrier member; a delivery drum supported immediately beneath said supply drum, means is provided for rotating said drum for rotation in a direction counter to the second rotational direction, but conforming to the first rotational direction, at the same peripheral velocity as that of said supply and rectifying drums, said delivery drum having its outer peripheral surface divided into perforated and solid zones which alternate with each of said zones being of equal length in a circumferential direction, said perforated zones of the outer peripheral surface of said delivery drum being formed with a circumferentially extending row of radially inwardly recessed delivery pockets for receiving therein the capsules from the rectifying drum at said second transfer station, said delivery drum being operable to transport the capsules, received from the rectifying drum, from said rectifying drum, from said second transfer station to a delivery station at which the capsules are discharged in the top-capped position from the rectifying pockets for the transfer onto a subsequent processing station, and each of said delivery pockets in each said perforated zone of said delivery drum receiving the respective capsule in the top-capped position from the associated rectifying pocket at said second transfer station.

10. The apparatus as claimed in claim 9, wherein each of said radial pocket portions has outer and inner portions of a diameter greater and smaller than the outer diameter of the cap body, respectively, the outer portion thereof having a depth smaller than the length of the respective capsule such that, when the capsule is received in the respective rectifying drum in the bottom-capped position, the cup body of such capsule can project radially outwardly from the outer periphery of the rectifying drum.

11. The apparatus as claimed in claim 9, wherein said barrier member extends arcuately along the rectifying drum from a position adjacent said first transfer station to said second transfer station.

* * * * *